US009689210B2

(12) United States Patent
Moller et al.

(10) Patent No.: US 9,689,210 B2
(45) Date of Patent: Jun. 27, 2017

(54) DIAMOND MINING CORE DRILL BIT AND METHODS OF MAKING THEREOF

(71) Applicant: Diamond Products, Limited, Elyria, OH (US)

(72) Inventors: Karl H. Moller, North Palm Beach, FL (US); Thomas G. Ruffner, Oberlin, OH (US)

(73) Assignee: DIAMOND PRODUCTS, LIMITED, Elyria, OH (US)

( * ) Notice: Subject to any disclaimer, the term of this patent is extended or adjusted under 35 U.S.C. 154(b) by 800 days.

(21) Appl. No.: 14/045,281

(22) Filed: Oct. 3, 2013

(65) Prior Publication Data

US 2014/0138162 A1 May 22, 2014

Related U.S. Application Data

(60) Provisional application No. 61/842,658, filed on Jul. 3, 2013, provisional application No. 61/829,538, filed on May 31, 2013, provisional application No. 61/728,857, filed on Nov. 21, 2012.

(51) Int. Cl.
*E21B 10/48* (2006.01)

(52) U.S. Cl.
CPC ..... *E21B 10/48* (2013.01)

(58) Field of Classification Search
CPC ..... E21B 10/48
See application file for complete search history.

(56) References Cited

U.S. PATENT DOCUMENTS

| | | | |
|---|---|---|---|
| 2,543,861 | A | 3/1951 | Mader |
| 2,662,738 | A | 12/1953 | Davis et al. |
| 2,738,167 | A | 3/1956 | Williams, Jr. |
| 2,996,061 | A | 8/1961 | Miller |
| 3,113,626 | A | 12/1963 | Salisbury et al. |
| 3,412,813 | A | 11/1968 | Johnson |
| 3,464,655 | A | 9/1969 | Schuman |
| 3,537,538 | A | 11/1970 | Generoux |
| 3,736,995 | A | 6/1973 | Salter |
| 3,802,130 | A | 4/1974 | Lindenbeck |
| 3,833,077 | A | 9/1974 | Lavallee |
| 4,128,136 | A | 12/1978 | Generoux |

(Continued)

FOREIGN PATENT DOCUMENTS

| | | |
|---|---|---|
| EP | 0352546 | 1/1990 |
| EP | 2177303 | 4/2010 |

*Primary Examiner* — John Kreck
(74) *Attorney, Agent, or Firm* — Rankin, Hill & Clark LLP

(57) ABSTRACT

A core drill bit includes an elongate hollow cylindrical body having opposite first and second end sections, a plurality of cutting segments with a connecting portion joined to the second end section, a plurality of reinforcing members joined to the second end section between the cutting segments and contacting adjacent cutting segments to offer rotational support thereto, and a plurality of current concentrators disposed on one or both of the second end section and the connecting portion. The cutting segments being capacitive discharge welded to the second end section whereby the surface of the second end section melts during the welding to affix the cutting segments with the tool body. The cutting segments include diamonds dispersed therein with portions having varying diamond concentrations.

22 Claims, 16 Drawing Sheets

(56) References Cited

U.S. PATENT DOCUMENTS

| | | | | | |
|---|---|---|---|---|---|
| 4,208,154 | A | * | 6/1980 | Gundy | B28D 1/041 125/20 |
| 4,711,609 | A | | 12/1987 | Seefluth | |
| 4,915,182 | A | * | 4/1990 | Magyari | B28D 1/041 175/394 |
| 5,069,584 | A | | 12/1991 | Obermeier et al. | |
| 5,393,175 | A | | 2/1995 | Courville | |
| 5,590,729 | A | | 1/1997 | Cooley et al. | |
| 5,653,812 | A | | 8/1997 | Petrmichl et al. | |
| 5,996,571 | A | | 12/1999 | Jedick | |
| 6,033,295 | A | * | 3/2000 | Fisher | B24D 3/06 125/15 |
| 6,209,420 | B1 | | 4/2001 | Butcher et al. | |
| D466,139 | S | * | 11/2002 | Kim | D15/139 |
| 6,595,844 | B1 | | 7/2003 | Mizuno et al. | |
| D481,045 | S | | 10/2003 | Ahn | |
| 6,742,611 | B1 | | 6/2004 | Illerhaus et al. | |
| 6,846,341 | B2 | | 1/2005 | Middlemiss | |
| 6,868,848 | B2 | | 3/2005 | Boland et al. | |
| 7,204,244 | B1 | | 4/2007 | Pedersen | |
| 7,641,004 | B2 | | 1/2010 | Lapointe | |
| 8,210,287 | B1 | | 7/2012 | Moller et al. | |
| 2003/0029296 | A1 | | 2/2003 | Donazzan | |
| 2009/0022560 | A1 | | 1/2009 | Liemke | |
| 2010/0170720 | A1 | * | 7/2010 | Baril | B28D 1/041 175/393 |
| 2011/0297449 | A1 | * | 12/2011 | Dennis | F16C 33/26 175/426 |

* cited by examiner

FIG. 1aaa

DIAMOND MINING CORE DRILL BIT AND METHODS OF MAKING THEREOF

CROSS-REFERENCE TO RELATED APPLICATIONS

The present application claims benefit from U.S. Provisional Patent Application Ser. No. 61/728,857 filed Nov. 21, 2012 and U.S. Provisional Patent Application Ser. No. 61/829,538 filed May 31, 2013, and U.S. Provisional Patent Application Ser. No. 61/842,658 filed Jul. 3, 2013 all of which are incorporated herein by reference.

FIELD OF THE INVENTION

The present application relates to diamond cutting tools. More particularly, the present application concerns new and improved diamond mining core drill bits and reamers for cutting and reaming rock and earth, and to methods of manufacturing diamond mining core drill bits and reamers.

BACKGROUND OF THE INVENTION

Diamond core drilling equipment is used extensively to drill circular or annular holes in rock, earth, and related materials for a variety of reasons. For example, holes are drilled in rock during mining or during exploration for purposes of determining soil compaction, determining soil percolation or to perform other geological research.

Prior art diamond core drill bits or hole saws of a general type that are commonly used in mining applications have cutting segments of such bits that are commonly attached using infiltration techniques.

Generally speaking, diamond core drilling equipment comprises a motor-driven core drill assembly including a down-hole mining core drill bit or hole saw. The core drill assembly may embody various configurations, but such assembly generally comprises a base and a guide column extending up from the base or a drilling rig. A carriage may be provided between the column and the motor for guiding the motor along the column as the pipe extensions and mining core drill bit are advanced beneath the ground surface. Generally, the core bit is attached to the pipe extensions using a driver or reaming tool.

The prior art provides various types of core drill bits for use in mining. However, the majority of commercial mining bits used today have cutting heads formed of a diamond impregnated (infiltrated) material. More particularly, the cutting head comprises a plurality of cutting segments or teeth mounted at the distal end of the cylindrical body of the bit. Each of the segments normally has a uniform concentration of diamond particles dispersed throughout the segments and is attached to the cylindrical body of the bit using an infiltration process. This attachment process, however, is a time consuming operation, it is costly, and may at times result in inadequate adhesion of the segments with the body especially when the segments are highly loaded with diamond particles. Often, the infiltrated material "drips" onto unintended portions of the body and must be cleaned afterwards or fails to adhere properly to the diamond impregnated cutting segments. A substantial investment of energy and time may be required to clean the tool of the stray brazing material and to properly adhere each cutting segment. Additionally, the uniform dispersion of diamonds in the cutting segments may produce only adequate drilling efficiency.

BRIEF SUMMARY OF THE INVENTION

The present invention provides a new and improved diamond mining core drill bit or hole saw for cutting annular holes in rock, earth, and similar materials and, further, includes methods of manufacturing these mining core drill bits. The present invention also provides an improved reamer attachment for the diamond mining core drill bit. The drill bit, reamer, and method of making the drill bit and reamer provide several distinct advantages over the bits, reamers, and methods of the prior art. More particularly, the present invention provides a drill bit and reamer with a cutting head securely mounted to the drill bit body and provides reaming segments securely mounted to the reamer. The cutting head on the drill bit constitutes a plurality of cutting segments. The cutting head has a plurality of reinforcing members for supporting the cutting segments. The reamer has a plurality of reamer segments attached thereto. The cutting segments and reaming segments, each include two or more portions having varying concentrations of diamond particles dispersed therein. The present invention also provides a method for constructing a diamond mining core drill bit and reamer that is simpler than the prior art methods and provides a lower cost drill bit and reamer that exhibits a better adhesion or coupling between the cylindrical body of the bit and the one or more cutting segments and also between the reamer and reamer segments. The method of the present invention also allows for the use of segments having varied compositions without concern for loss of bond integrity as between the segments and the bit body. Bits and reamers having this construction have a lower production cost and exhibit a truer cut, better tracking, and a longer life as compared to prior art bits.

In one embodiment, a mining drill bit is provided comprising a hollow cylindrical body, a plurality of cutting segments, and a plurality of reinforcing members. The hollow cylindrical body has a first end section and an opposite second end section. The plurality of cutting segments are attached to the second end section in a manner that provides a resistance to shear forces exerted on the cutting segments during a drilling operation of an associated material. The cutting segments are circumferentially spaced apart on the second end section to thereby define gap regions on the second end section between the cutting segments. The plurality of reinforcing members are attached to the second end section in each of the gap regions for increasing the resistance of the cutting segments to the shear forces of cutting. In one embodiment the reinforcing members are separate and distinct from the body and the segments. In another embodiment the reinforcing members are formed from the body, and thus an integral part of the body but separate and distinct from the cutting segments. Preferably, the cutting segments have a height greater than a height of the reinforcing members.

In another embodiment a mining core drill bit is provided, comprising a hollow cylindrical body and a plurality of cutting segments joined thereto. The cylindrical body has a first end section and an opposite second end section. The plurality of cutting segments each have a connecting portion being joined with the second end section of the body. A plurality of current concentrators is present on a surface of at least one of i) the second end section, and ii) the connecting portion. If the current concentrators are only on the surface of the second end section, then the second end section has a shape defined by two or more planes. If the current concentrators are on the surface of the connecting portion, with or without also being on the surface of the second end section, then the shape of the second end section is defined by one or more planes. The shape of the connecting portion is defined by one or more planes that are substantially parallel to the one or more planes defining the shape of the second end section.

In another embodiment, a method of making a drill bit is provided. The method comprises providing a hollow cylindrical body having a first end section and an opposite second end section, the second end section having a plurality of current concentrators. The method includes providing a plurality of cutting segments having diamond particles dispersed therein. The method includes providing a plurality of reinforcing members. The method includes mounting the cutting segments to the second end section by capacitive discharge welding, wherein the cutting segments are circumferentially spaced on the second end section to define gap regions between the cutting segments. The method includes providing reinforcing members between the cutting segments. In one embodiment the reinforcing members are formed from the body, and in another embodiment the reinforcing members are separate and distinct members that are attached to the second end section by capacitive discharge welding or by laser welding, wherein at least one of the reinforcing members is in each of the gap regions and the reinforcing members contact adjacent cutting segments. In one embodiment the segments, and optionally the reinforcing members, are attached by a combination of capacitive discharge welding and laser welding.

As will be realized, the subject matter described herein is capable of other and different embodiments and its several details are capable of modifications in various respects, all without departing from the claimed subject matter. Accordingly, the drawings and description are to be regarded as illustrative and not restrictive.

BRIEF DESCRIPTION OF THE DRAWINGS

The foregoing aspects and others will be pointed out more fully hereinafter in conjunction with the written description of the various embodiments of the invention illustrated in the accompanying drawings in which:

FIG. 1*aa* is a top view of a core drill bit made in accordance with the present invention, and FIG. 1*aaa* is a schematic cross-sectional view taken along line 1*aaa* of FIG. 1*aa*.

FIG. 2*a* is the core drill bit of FIG. 1*d*, as viewed along lines 2*a*-2*a*. FIG. 2*b* is the core drill bit of FIG. 1*e*, as viewed along lines 2*b*-2*b*. FIG. 2*c* is the core drill bit of FIG. 1*f*, as viewed along lines 2*c*-2*c*.

DETAILED DESCRIPTION OF THE INVENTION

Figure 1A:
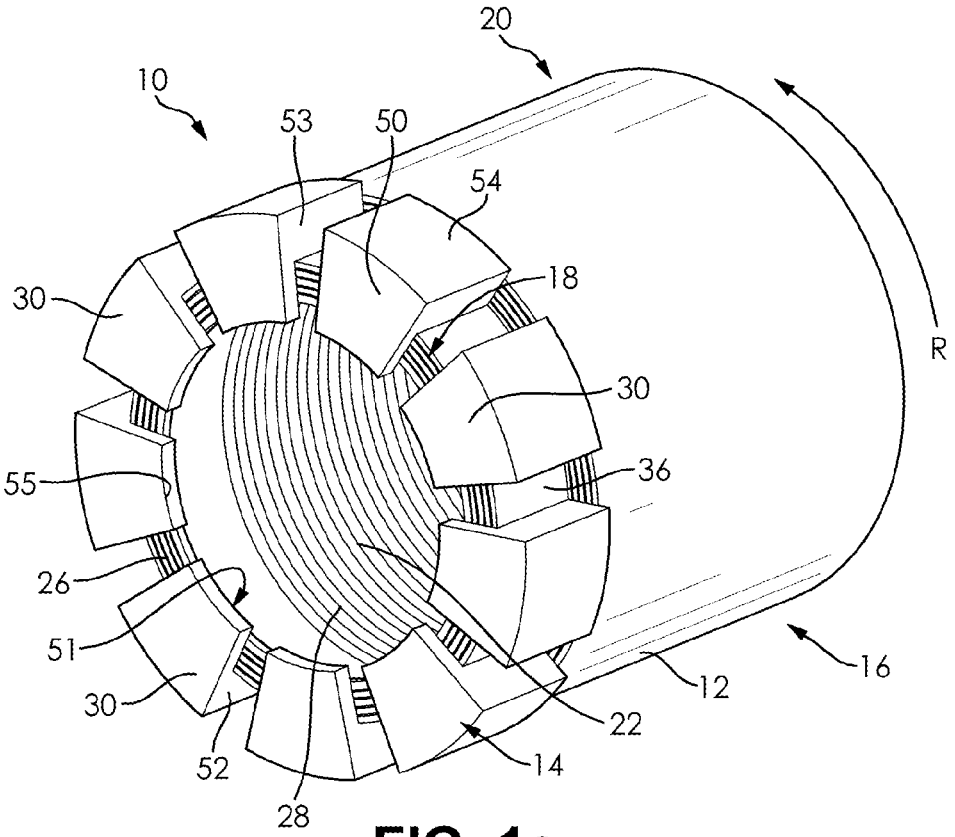
FIGS. 1*a*-1*f* are perspective views of core drill bits made in accordance with the present subject matter.
Figure 1A:
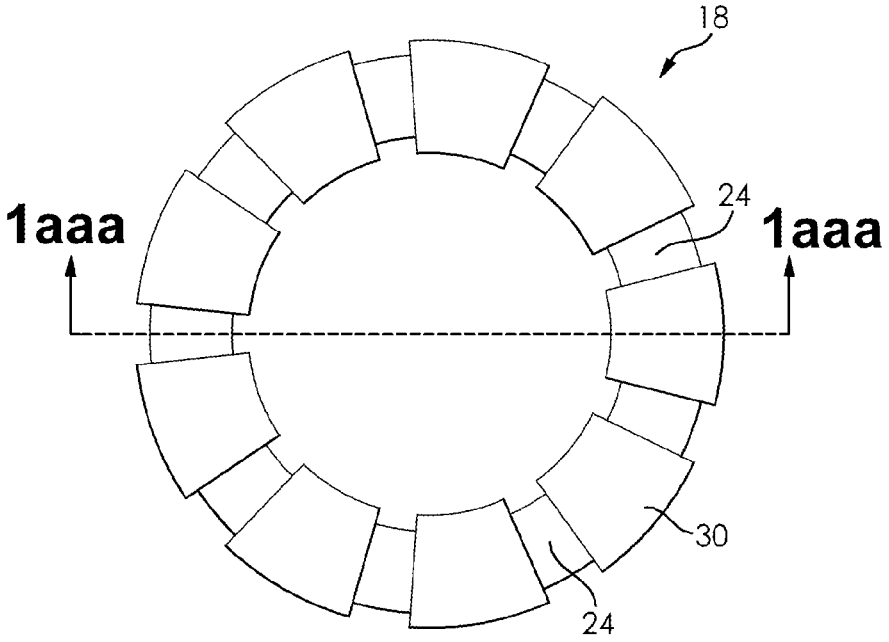

The present invention provides a new an improved mining core bit, and it relates to the bit shown in Moller et. al. U.S. Pat. No. 8,210,287 which is incorporated herein in its entirety. The diamond mining core drill bit tool of the present invention comprises a hollow cylindrical body 12 having a first end section 16 and opposite second end section 18. The first end 16 is adapted to connect to a reamer or drill pipe for rotating the tool in relation to an associated material to be drilled. The body of the drill and the reamer are commonly formed of steel as is conventional in the mining drill industry. The second end section 18 has a cutting head 14 mounted thereto. The cutting head 14 comprises a plurality of cutting segments, each cutting segment having a connecting portion 38 that is capacitive discharge welded to the second end section. The second end section 18 also has reinforcing members 24 attached thereto between the cutting segments that support the cutting segments. The tool also comprises a plurality of current concentrators 26 disposed on the surface of at least one of i) the second end section 18 of the cylindrical body, and ii) the connecting portion 38 of the cutting segments.

Drill Bit Body

Figure 1B:
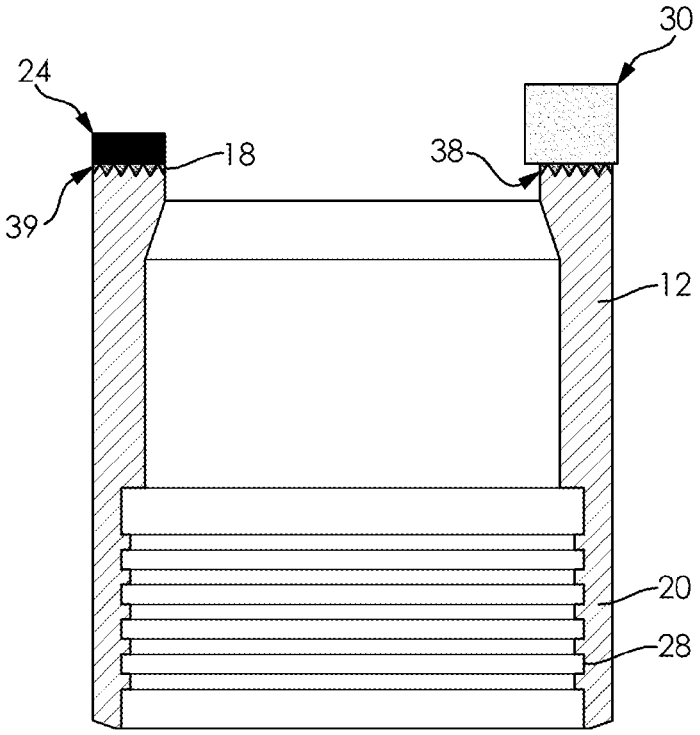
Figure 1B:
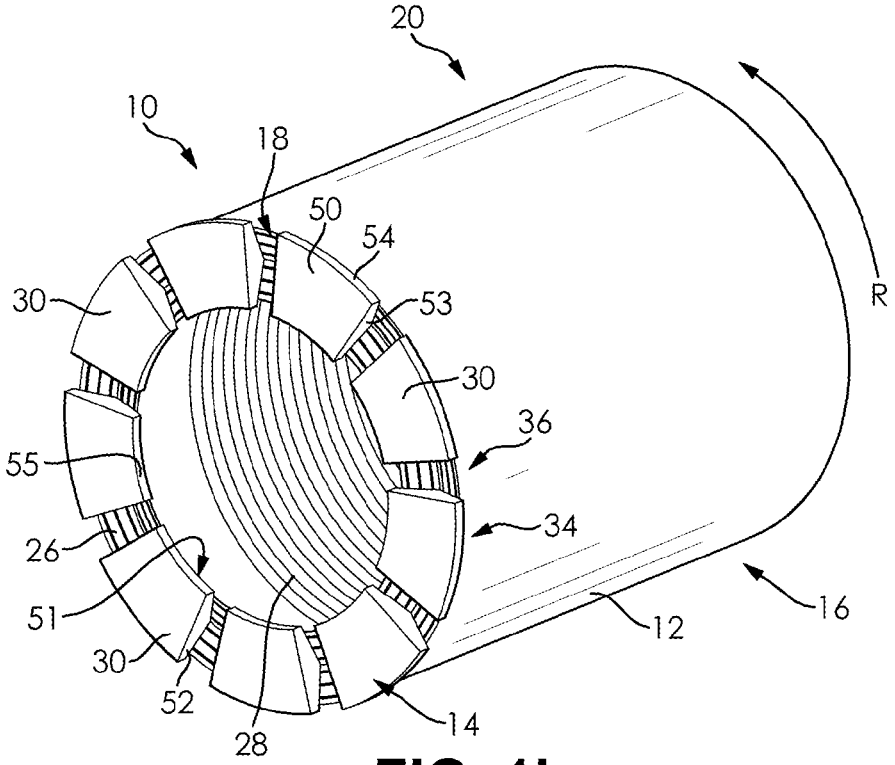
Figure 1C:
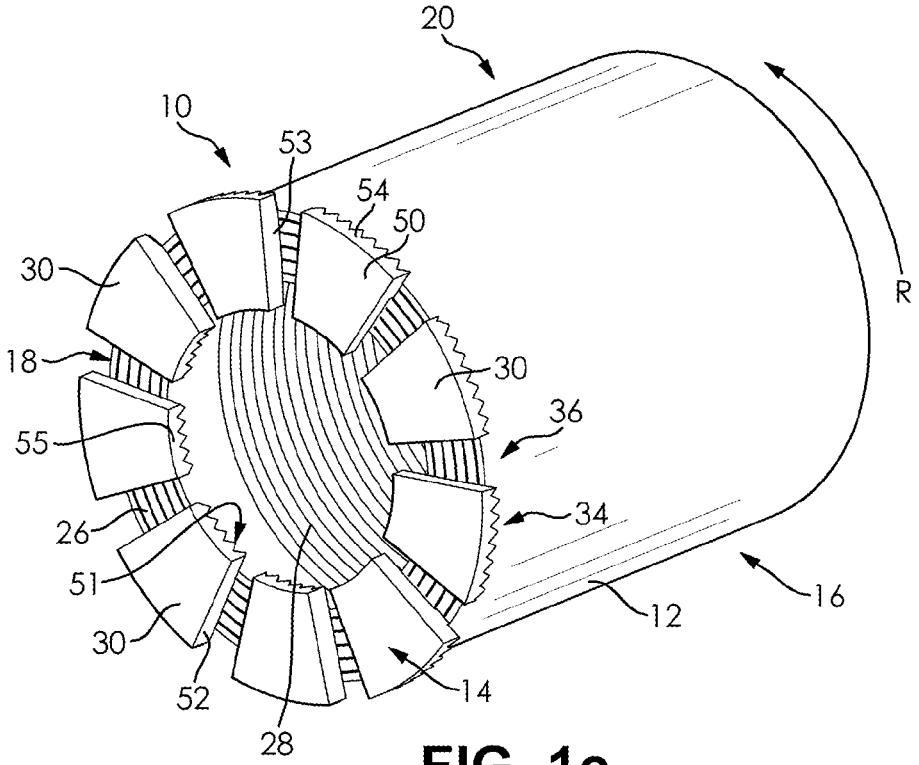
Figure 1D:
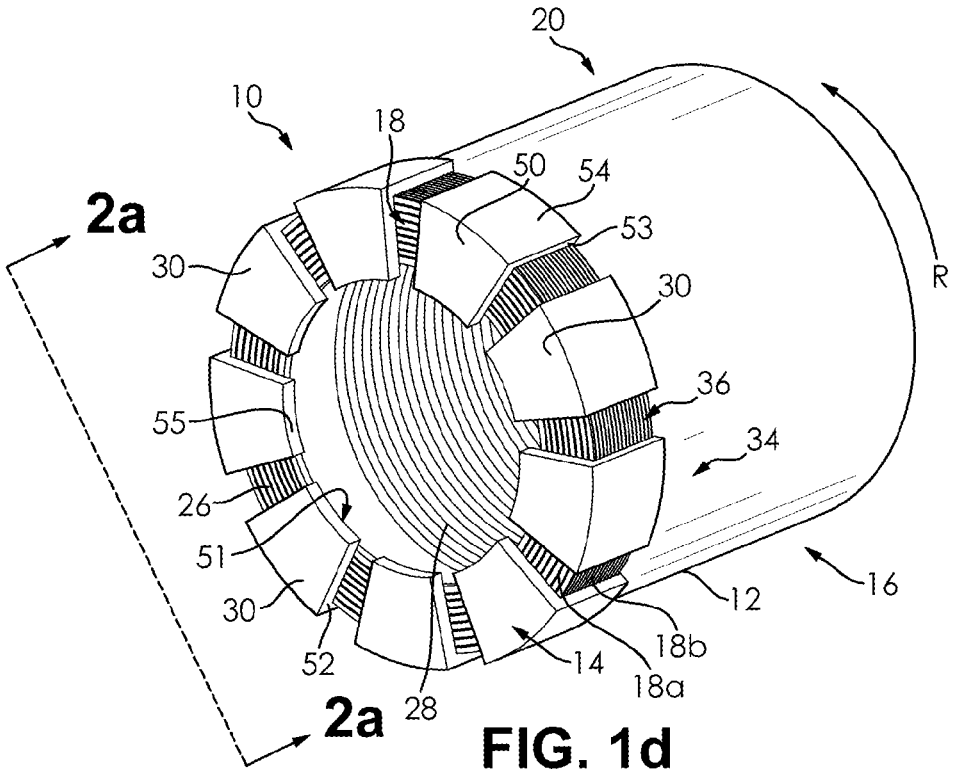
Figure 1E:
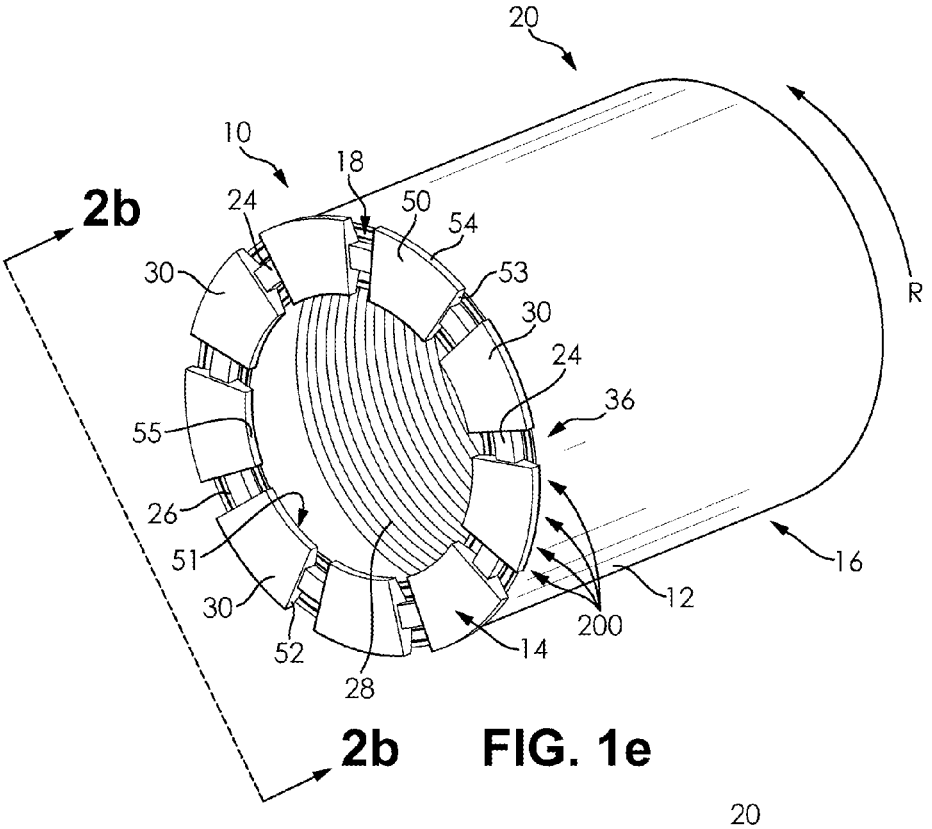
Figure 1F:
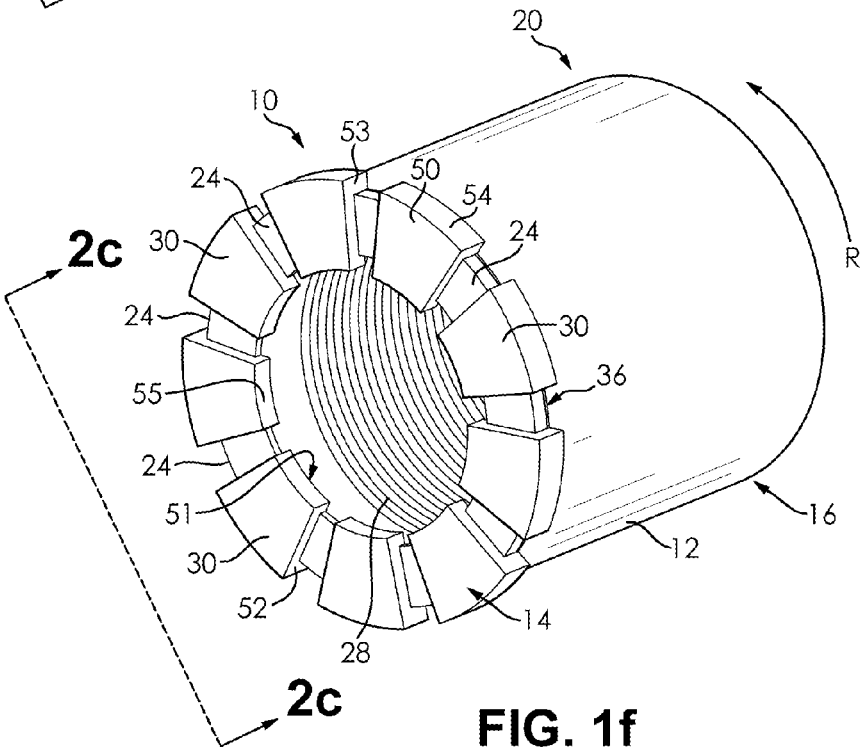
Figure 1G:
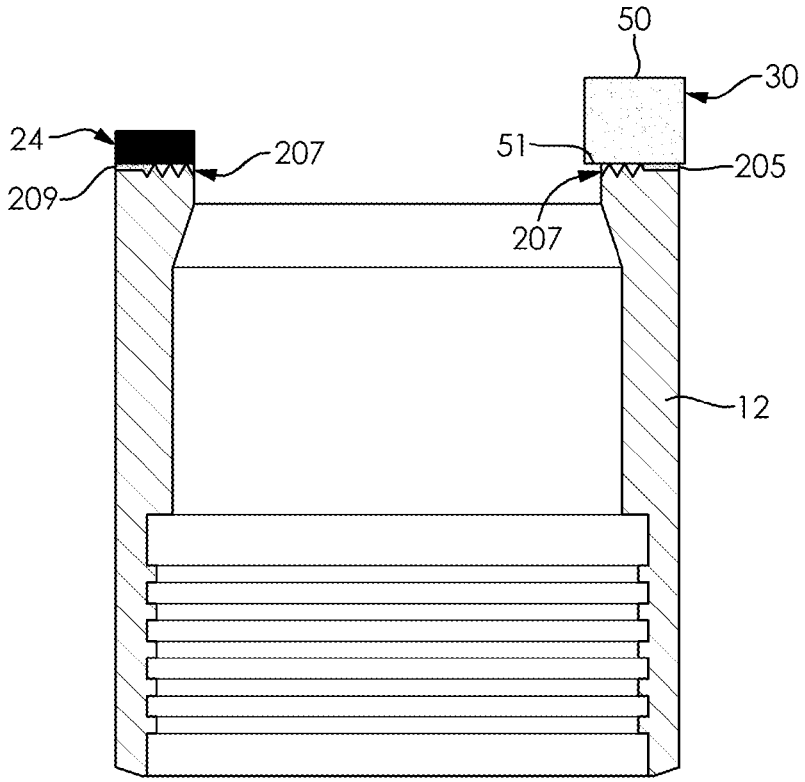
FIG. 1*g* is a schematic cross-sectional view of a cutting segment and reinforcing member that have been attached using both capacitive discharge welding and laser welding.
Figure 2A:
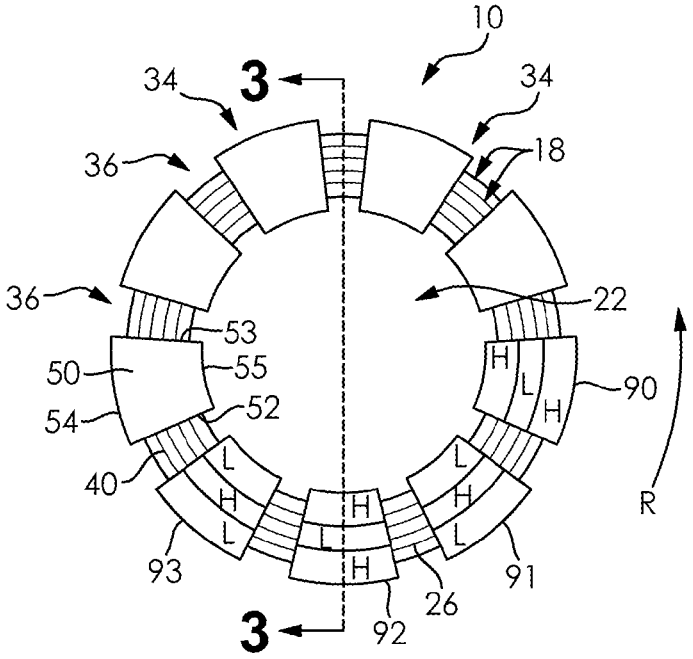
FIGS. 2*a*-2*c* are end views of the core drill bit.
Figure 2B:
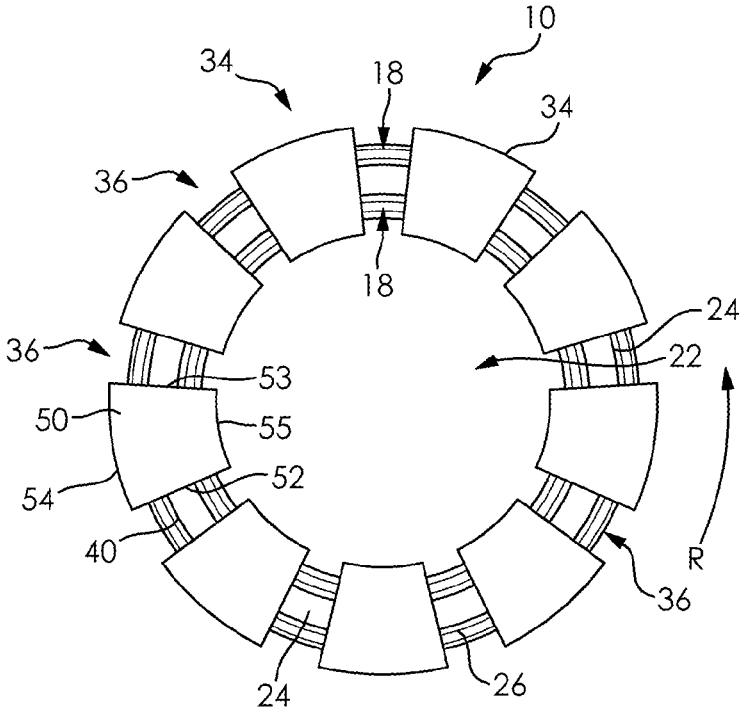
Figure 2C:
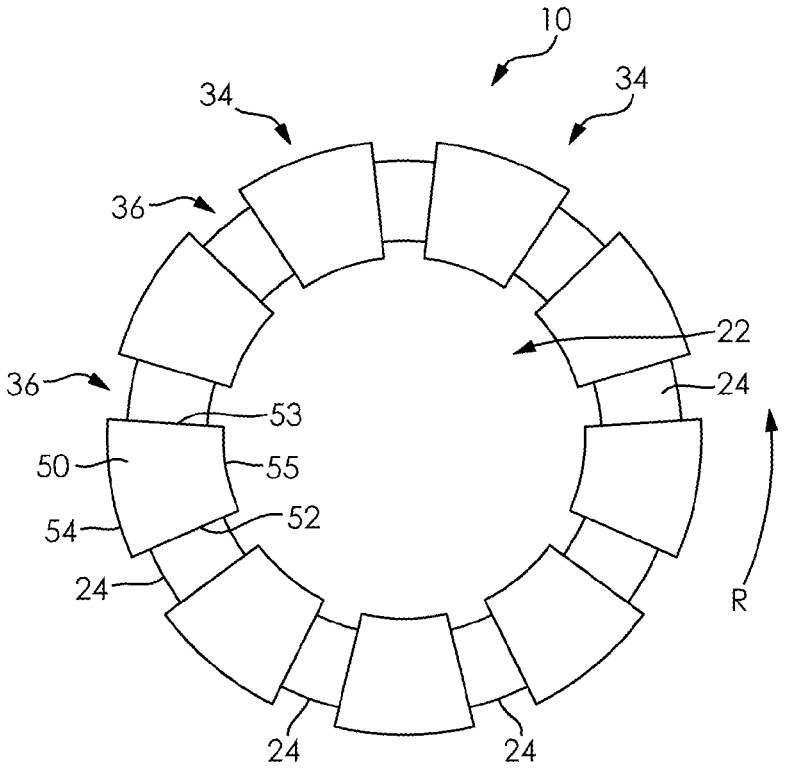
Figure 3:
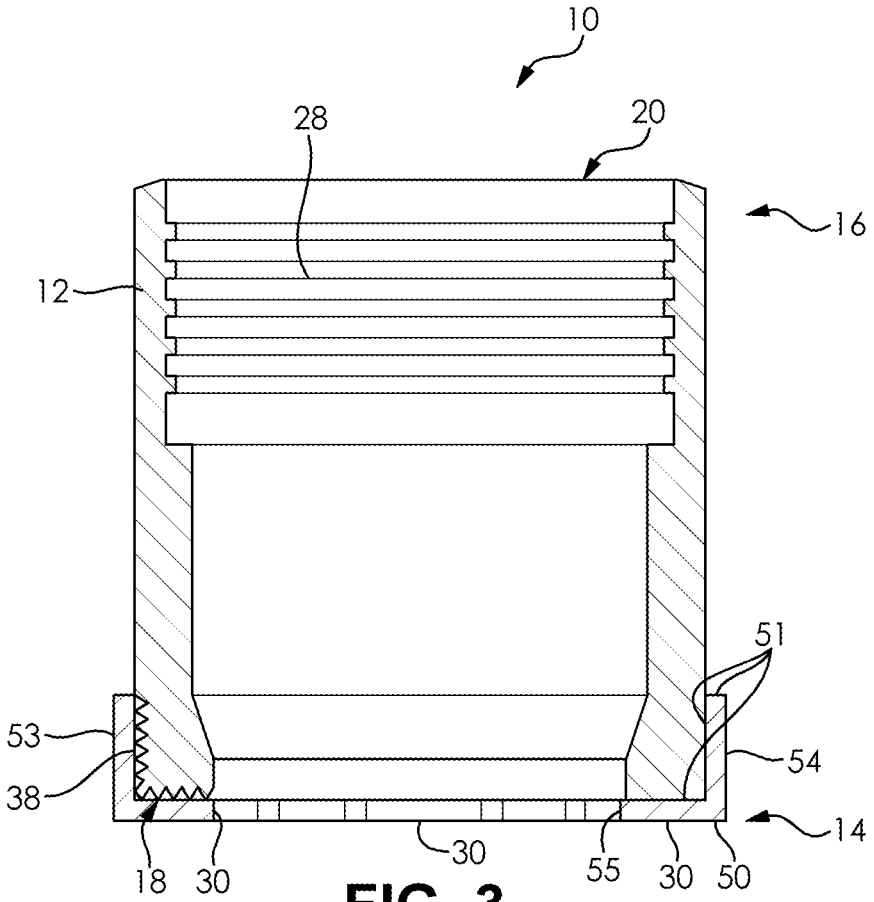
FIG. 3 is a cross-sectional view taken along lines 3-3 of FIG. 2*a*.

Referring now to the drawings wherein the showings are for purposes of illustrating non-limiting examples of exemplary embodiments of the invention only and not for purposes of limiting same, and initially to FIGS. 1*a*-1*g*, 2*a*-2*c*, and 3, there is shown core drill bits 10 formed in accordance with the present invention. In the various Figures the same reference numerals have been used to identify similar elements. The bit 10 includes an elongate hollow cylindrical body 12 and a cutting head 14 disposed on the body 12. The body 12 has a first end section 16 and an opposite second end section 18. The body has a length defined by the distance from the distal end of the first end section 16 to the distal end of the second end section 18. The hollow body 12 has a thickness defined by the distance between the opposite sides of the hollow body, i.e. the difference between the inside and the outside radius of the cylindrical body. The thickness of the body 12 may vary as shown in FIG. 3.

The first end section 16 has an attaching portion 20 for selectively attaching the core drill bit 10 to an associated driver such as, for example, a reamer or drill pipe for rotating the core drill bit 10 relative to the associated material. The second end section 18 is joined with a plurality of cutting segments 30 and optionally joined with a plurality of reinforcing members 24 to define a cutting head 14. The second end section 18 is defined by a portion of the body 12 that is joined to a connecting portion 38 of the cutting segments 30 along with portions of the body 12 located therebetween. The cutting head 14 is formed on the second end section 18.

Further, the cylindrical body 12 defines a circular hole or opening 22 therethrough so that the drill bit may function as a coring drill bit to remove or extract materials such as, for example, soil samplings, and/or rock or other formations. Also, the opening 22 at the first end section 16 enables access to the attaching portion 20. In one embodiment, the attaching portion 20 comprises an internal threaded portion 28 as illustrated in the FIGS. 1*a*-1*f* and FIG. 3. The internal threaded portion 28 enables the selective connection of the subject drill bit 10 with an associated reamer, drill pipe, or driving member, having corresponding external threaded portions. Referring to FIG. 1*aa* there is shown a top view of a bit 10 where the reinforcing members 24 occupy the entire width of the second end section 18 of the body 12. Referring to FIG. 1*aaa* there is schematically illustrated the weld formed by capacitive discharge welding at the connecting portion 38 of the segments 30 and the connecting portion 39 of the reinforcing members 24.

In an exemplary embodiment and with continued reference to the drawing figures, in particular to FIGS. 2*a*-2*c*, each of the plurality of cutting segments 30 is circumferentially spaced apart evenly on the second end section 18 to define alternating cutting segment regions 34 and gap regions 36 of the cutting head 14. It will be appreciated that it is not necessary for the cutting segments 30 to be evenly spaced apart, but only that the cutting segments 30 have space between them on the second end section 18 to define gap regions 36 on the cutting head 14.

Drill Bit Cutting Head

With continued reference to FIGS. 1*a*-1*f*, 2*a*-2*c* and 3, and in an exemplary embodiment, the cutting head 14 of the subject drill bit 10 comprises a plurality of separate and distinct cutting segments 30 mounted to the second end section 18 of the body 12 such that the cutting head and the body are one unitary piece. However, it will be appreciated that one could form bit 10 by capacitive discharge welding cutting segments to a drill bit body. As shown in FIGS. 1*a*-1*f*, 2*a*-2*c*, 3 and 10*a*-10*g*, and in relation to the direction of rotation R of the drill bit 10, the cutting segments 30 each have a top face 50, a bottom face 51 comprising the connecting portion 38, a leading face 52, a trailing face 53, an outer face 54, and an inner face 55.

The cutting segments 30 have a height, a width, and a length measurement. When referring to the height of the cutting segments, it is meant the average of the largest and smallest measurements between the top face 50 and the bottom face 51. When referring to the width of the cutting segments, it is meant the average of the largest and smallest measurements between the outer face 54 and the inner face 55. When referring to the length of the cutting segments, it is meant the average of the largest and smallest measurements between the leading face 52 and the trailing face 53. It will be understood that respectively opposite faces of the cutting segments, i.e. top and bottom, outer and inner, and leading and trailing, can be but are not necessarily parallel to each other, and the cutting segments can be irregularly shaped in accordance with the present subject matter, such as wedge or pie shaped. The shape and dimensions of the segment are generally configured to meet the desired drilling application.

As with conventional bits, the cutting segments 30 are slightly wider than a thickness of the hollow cylindrical body 12 at the second end section 18 as shown in the figures, so as to provide sufficient clearance for the body during mining, drilling, or cutting operations. In one embodiment, the cutting segments have a width that is about 1.0 to about 2 times the thickness of the body 12 at the second end section 18. In one aspect, the cutting segments have a width that is about 1.2 to about 1.8 times the thickness of the body at the second end section.

In one embodiment, the cutting segments are attached to the second end section 18 so that each cutting segment simultaneously extends both radially in towards the opening 22 and radially out away from the opening; both extending over the thickness of the body at the second end section. That is, the cutting segments are attached so that the outside face 54 and inside face 55 of the cutting segments extend past and hang over both sides of the body 12 at the second end section 18 to create a kerf wider than the drill bit body. This can be seen in FIGS. 1*a* and 1*aa*.

In one embodiment, the cutting segments 30 are circumferentially spaced apart substantially evenly on the second end section 18 to define gap regions 36 as best illustrated in FIGS. 2*a*-2*c*. The distance between adjacent cutting segments, which defines each gap region, is the average of measurements between one cutting segments and an adjacent cutting segments. As shown in one embodiment in FIGS. 1*a*-1*f* and 2*a*-2*c*, a total of nine (9) cutting segments 30 are provided. More or less segments may be used as necessary or desired. In one aspect, the length of the cutting segments is about 1.1 to about 5.0 times the distance between adjacent cutting segments that define the gap regions 36 on the cutting head 14. In a particular aspect, the length of the cutting segments 30 is about 1.2 to about 3 times the distance between adjacent cutting segments 30 on the cutting head 14.

In one embodiment, the cutting segments 30 comprise almost any metal including a mixture of metals such as, for example, one or more of molybdenum, silver, iron, copper, cobalt, and alloys of such metals, and metal carbides, and mixtures thereof, along with diamonds. In one embodiment the cutting segments comprise a mixture of about 30% iron, 30% copper, 30% cobalt, 10% tungsten carbide by weight of the metal mixture. In one aspect, the cutting segments 30 further include diamond particles/grit/powder dispersed therein at about 0.01-90% by weight of the cutting segments. In one particular aspect, the cutting segments comprises at least about 2% diamond particles by weight. In another particular aspect, the cutting segments comprise from 3% to about 80% by weight of diamond particles. As discussed in more detail herein, the concentration and arrangement of diamond particles as well—as the relative amount of other components, for example the percentage of each metal in the mixture—can be varied between different portions of the cutting segments. Other compositions may be utilized as well.

In one embodiment, the cutting segments 30 have a top face 50 with a shape other than a flat shape that is perpendicular to the drill bit body 12. FIGS. 14*a*-14*k* are non-limiting examples showing the cutting segments 30 having a top face 50 with the varying shapes. The top face 50 comes into contact with the associated material during drilling operations and can be in the form of a flat face (FIG. 1*a* for example), a sloped face (FIGS. 14*a*-14*b*), a curved face (FIGS. 14*e*-14*f*), a stepped face (FIGS. 14*c*-14*d* and 14*h*-14*i*), a jagged face (FIGS. 14*g* and 14*k*), have a depression therein (FIG. 14*j*), or combinations thereof. It is contemplated that the top face 50 can have various other forms not limited by the examples provided herein.

Figure 13A:
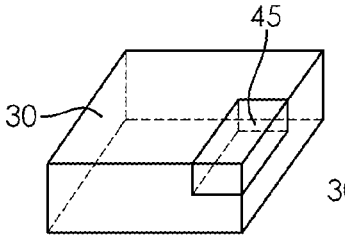
FIGS. 13*a*-13*f* are perspective views showing various configurations of cutting segments having an insert.
Figure 13B:
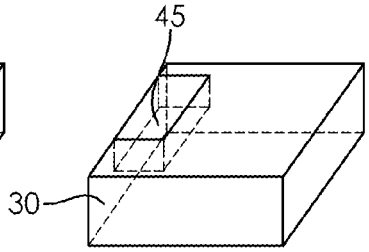
Figure 13C:
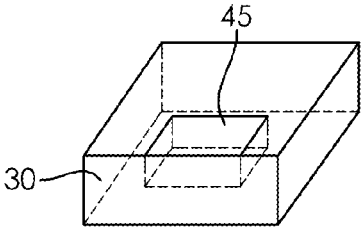
Figure 13D:
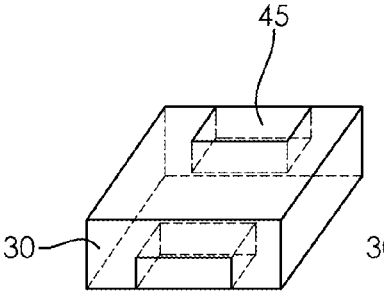
Figure 13E:
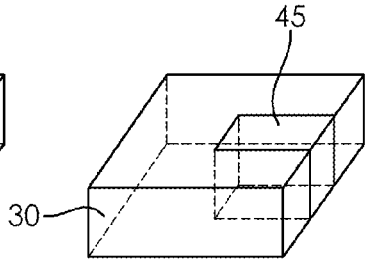
Figure 13F:
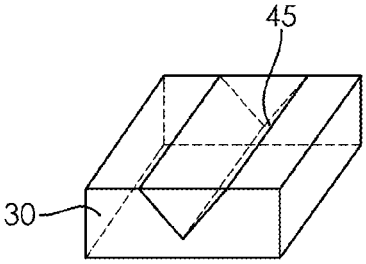
Figure 14A:
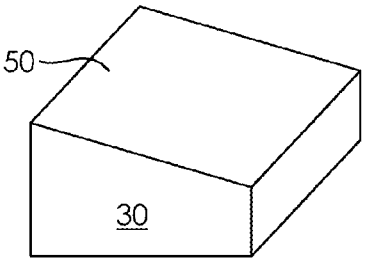
FIGS. 14*a*-14*k* are perspective views showing cutting segments having various top face configurations.
Figure 14B:
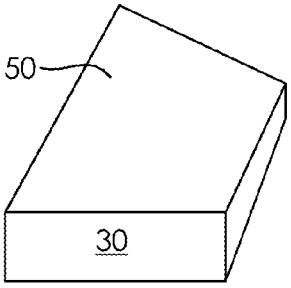
Figure 14C:
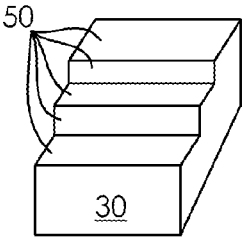
Figure 14D:
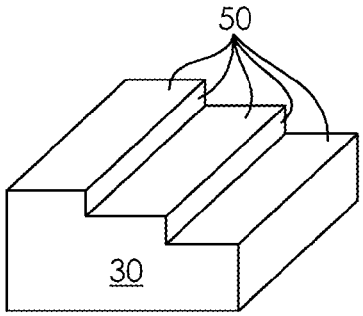
Figure 14E:
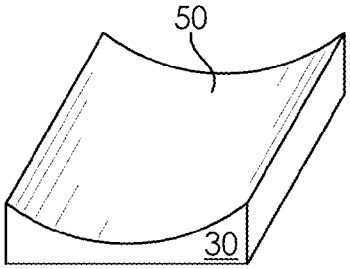
Figure 14F:
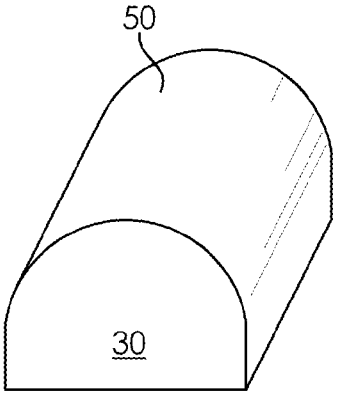
Figure 14G:
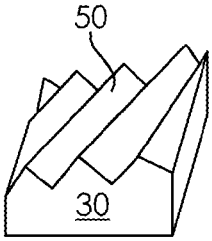
Figure 14H:
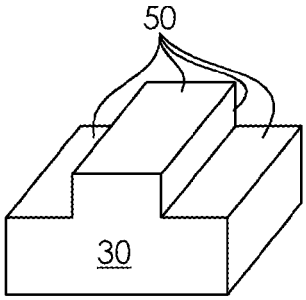
Figure 14I:
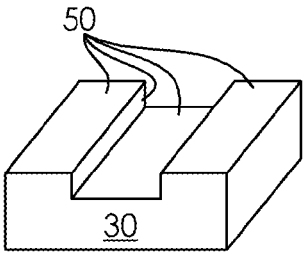
Figure 14J:
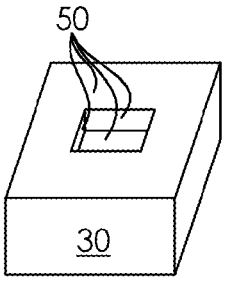
Figure 14K:
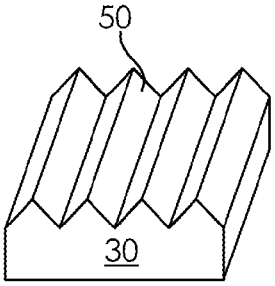

In one embodiment, the cutting segments 30 each have an insert 45. The insert 45 can be positioned anywhere within the cutting segment 30. The insert 45 is cold pressed and fired and/or sintered to form the cutting segment 30 and comprises a metal such as, for example molybdenum, tungsten, silver nickel, iron, copper, cobalt or mixtures and alloys thereof including carbides of various metals. Shown by non-limiting example in FIGS. 13*a*-13*f* are cutting segments 30 having an insert 45 disposed therein and having various configurations. As shown in FIG. 13*d*, the cutting segments 30 each can have one or more inserts 45.

In one embodiment, as shown by non-limiting example in FIGS. 1*e*-1*f* and 2*b*-2*c*, the cutting head 14 includes at least one reinforcing member 24 disposed in each of the gap regions between adjacent cutting segments 30. The reinforcing members are separate and distinct from the body and from the cutting segments. The reinforcing members are bonded to the second end section 18, to the cutting segments 30, or to both.

The reinforcing members 24 act to offer rotational support to the cutting segments 30 while the drill bit is in use and being rotated relative to an associated material. As the drill bit is being used, rotational or lateral forces act upon the cutting segments 30, working to shear the cutting segments from the second end section of the drill bit body. These rotational or lateral forces are produced by resistance from the associated material acting against the cutting segments during mining operations. The rotational forces act on the cutting segments in an opposite direction from the direction of rotation R of the drill bit to urge the cutting segments 30 to shear from their attached position on the second end section 18. The attachment between the cutting segments 30 and the second end section 18 provides a level of resistance to these rotational forces to keep the cutting segments 30 securely in place on the second end section 18.

Where reinforcing members are included in the cutting head 14, the reinforcing members 24 act to fortify the cutting segments' resistance to lateral, rotational, or shear forces by at least i) spanning the gap regions from one cutting segment 30 to an adjacent cutting segment; and by ii) themselves being secured to the second end section 18 and/or the cutting segments. These two functions (i) and (ii) together or separately, reinforce the resistance of the cutting segments 30 to rotational movement by providing substantially no room for the cutting segments to move laterally, and by providing a larger weld footprint (i.e. the weld area between the cutting segments 30 and the second end section 18 combined with the weld area between the reinforcing members and the second end section) to counteract the shear forces exerted on the cutting segments 30.

When referring to the height of the reinforcing members 24 in relation to the direction of rotation R, it is meant the average of the largest and smallest measurements between a top facet (that portion facing the associated material) to be drilled, and a bottom facet (that portion facing the second end section 18) of the reinforcing members. When referring to the width of the reinforcing members, it is meant an average of the largest and smallest measurements between an outer facet (that portion facing away from the opening 22) and an inner facet (that portion facing toward the opening 22) of the reinforcing members. When referring to the length of the reinforcing members, it is meant the average of the largest and smallest measurements between a leading facet (that portion facing the direction of rotation R and contacting cutting segment) and a trailing facet (that portion facing away from the direction of rotation R and contacting a cutting segment) of the reinforcing members.

In one aspect, the reinforcing members 24 are smaller than the cutting segments 30 in length, width, height, or a combination thereof. In one aspect as is shown in FIGS. 1*e*-1*f* and 2*b*-2*c*, the reinforcing members 24 are smaller than the cutting segments 30 in width, length, and height. Thereby, the reinforcing members 24 do not substantially interfere during a drilling operation with the contact between the associated material and the top face 50, the leading face 52, the outer face 54, or the inner face 55 of the cutting segments 30. In both aspects shown in FIGS. 1*e* and 2*b*, 1*f* and 2*c*, the reinforcing members span the gap regions to contact adjacent cutting segments in order to offer resistance to shear forces exerted on the cutting segments by providing substantially no room for the cutting segments to annularly move. It will be understood that the reinforcing members 24 are not limited by the depictions in FIGS. 1*e*-1*f* and 2*b*-2*c* and can include more than one reinforcing member between adjacent cutting segments or can be differently shaped.

The second end section 18 has a surface area that can be defined by square units of length, i.e. square inches, square centimeters, etc. In one embodiment of an assembled mining core drill bit, the cutting segments 30 occupy from about 25% to about 90% of the surface area of the second end section 18 (and preferably from about 30% to about 85%) and the reinforcing members take up the remaining area, wherein the entire surface area of the second end section is covered. In another aspect, the reinforcing members 24 do not occupy the entire remaining surface area so that some of the surface area of the second end section is exposed after assembly.

The shape, size, and configuration of the reinforcing members are not particularly critical as long as the reinforcing members offer adequate rotational support for the cutting segments 30 and do not substantially interfere with the drilling operations. In one aspect as shown in FIGS. 1*e* and 2*b*, the reinforcing members 24 do not fill the entire second end section 18 in the gap regions. That is, at least a portion of the second end section is still exposed in the gap regions after construction of the bit. In another aspect as shown in FIGS. 1*f* and 2*c*, the reinforcing members 24 do fill the entire second end section 18 in the gap regions. That is, none of the second end section is exposed in the gap regions after construction of the bit.

The cutting segments have a length, a width, or a height that are from about 1.1 to about 5.0 times the length, width, and height, respectively, of the reinforcing members when the drill bit is constructed. In one particular aspect, the cutting segments are at least about 3.0 times the height of the reinforcing members when the drill bit is constructed. In another aspect, the cutting segments are at least about 1.4 times the width of the reinforcing members when the drill bit is constructed. In another aspect, the cutting segments are at least about 1.25 times the length of the reinforcing members in an assembled drill bit.

The reinforcing members 24 can be made out of the same or different material as the cutting segments and can be made of various metals, non-metals, or mixtures thereof, either including diamonds dispersed therein or not. In one aspect, the reinforcing members are made from metal, such as steel, and are bonded to the second end section and/or the cutting segments by either laser or preferably capacitive discharge welding.

Figure 15A:
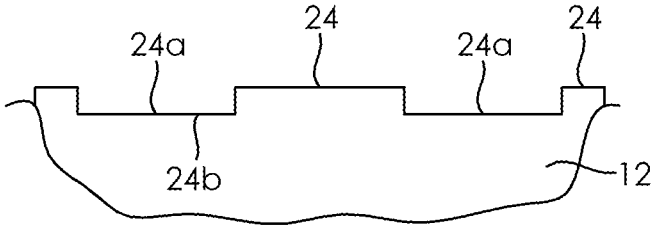
FIG. 15*a* is a broken-away schematic side view of a another embodiment of the core drill bit wherein the reinforcing members are formed in the sidewall of the bit.
Figure 15B:
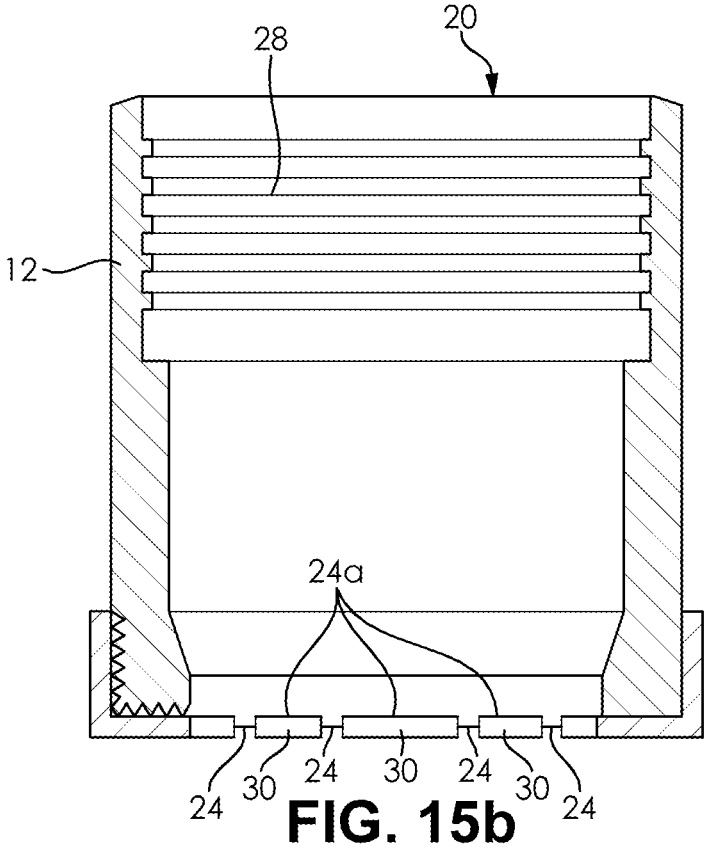
FIG. 15*b* is a schematic cross section illustrating the same configuration.

Referring now to FIGS. 15A and 15B there is shown a further embodiment of the invention wherein the reinforcing members 24 are formed in the body 12 by forming cut-outs 24*a* into which the cutting segments 30 are mounted. The top faces 24*b* of the cut-outs 24*a* is spaced below the top facet of the reinforcing members 24. Thus, in the embodiment the reinforcing members are an integral part of the drill body 12, but separate and distinct from the cutting segments 30.

Current Concentrators

In accordance with the present subject matter, and with continued reference to the figures, a plurality of current concentrators 26 are disposed on a surface of at least one of i) the second end section 18 of the body 12, and ii) the connecting portion 38 of the cutting segments 30. The current concentrators 26 are defined by a plurality of raised portions 40 that act to concentrate an electrical current during the capacitive discharge welding. The concentrated electrical current efficiently facilitates the attachment of the cutting segments 30 to the body 12 as discussed in further detail herein.

Figure 8A:
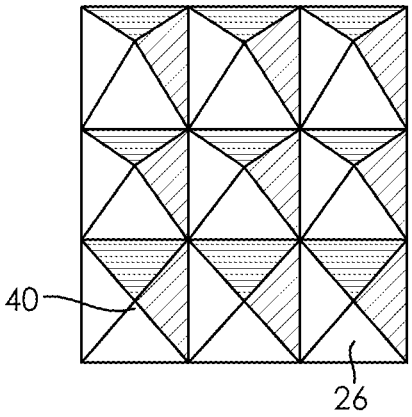
FIGS. 8*a*-8*b* are perspective views of two embodiments of a plurality of current concentrators.

The current concentrators 26 are defined by a plurality of raised portions 40 that taper to a point or edge. It is to be appreciated that, in accordance with one method of making a core drill bit in accordance with the present invention, the raised portions 40 function to channel and thereby concentrate current flowing between the drill bit body 12 and the cutting segments 30 during the capacitive discharge welding process. In one embodiment, the form of the tool body 12 is cylindrical and, accordingly, the current concentrators 26 define a plurality of concentric tapered ridges on the surface of the second end section 18 as shown in FIGS. 1*a*-1*c* and 1*e*. In FIG. 1*d*, the current concentrators 26 define both a plurality of concentric tapered ridges on one plane of the second end section 18 and a plurality of stacked tapered ridges on another plane of the second end section 18. Other forms of current concentrators at the interface between the cutting head 14 and the body 12 may be utilized as necessary, or desired, such as, for example, a plurality of spaced apart raised portions that taper to a point as shown in FIG. 8*a*, a plurality of radially extending ridge portions that taper to an edge such as those shown in FIG. 8*b*, or other shapes, patterns, or configurations provided on the second end section 18 and/or the connecting portion 38 of the cutting segments 30 to define the current concentrators 26.

In one embodiment, the cutting segments 30 are welded to the second end section 18 both by capacitive discharge welding and by laser welding. In this embodiment, the cutting segments 30 are first attached by capacitive discharge welding to the second end section 18. Thereafter, a conventional laser welder is used to further weld the cutting segments 30 to the body 12 thereby forming a hybrid weld. The laser welding further reinforces the attachment between the cutting segments 30 and the second end section 18. The reinforcing members 24 can also be laser welded after they have been discharge welded to the body.

In one aspect, the laser is directed toward the interface between the cutting segments 30 and the second end section 18 from the direction of the outer face 54 of the cutting segments 18. Specifically, the laser can be directed along the outer face 54 of the cutting segments 30 as generally indicated by reference 200 in FIG. 1*e* in the area where the bottom face 51 of the cutting segment contacts the body 12. The laser penetrates to a depth of about 10% to about 90% (preferably from about 15% to about 85%) of the thickness of the body 12 at the second end section 18 as measured from the outside radius of the cylindrical body to the inside radius of the body, to thereby form a laser weld which is really a form of a hybrid weld because it is a combination of both laser and capacitive discharge welding. It will be appreciated that depending upon the size of the body 12, the laser could be directed from the direction of the inner face 51 of the cutting segments, or even along one or more of the leading 52 or trailering faces 53 of the cutting segments. In some applications it may be possible to direct the laser and form welds from the direction of two or more of the outer face 54, inner face 51, leading face 52 or trailering face 54 of the cutting segments 30. The laser weld may also be directed at the outer and inner faces of reinforcing members 24 after such members have been capacitive discharge welded to the body. FIG. 1*g* is a schematic cross sectional view showing hybrid weld zone 205 and a capacitive discharge weld zone 207 on the inner face 51 of the cutting segment formed by directing a laser from the direction of the outer face 54 of segment 30 as shown in FIG. 1*e*. FIG. 1*g* also shows a hybrid weld zone 209 formed on reinforcing member 24 by directing a laser along the outside interface of the reinforcing member 24 and the second end section 18. The laser preferably penetrates to a depth of about 10% to about 90% (preferably 15% to about 85%) of the width of the reinforcing members 24. In FIG. 1*g* the hybrid weld zones 205 and 209 were formed after the segments 30 and reinforcing members 24 had been capacitive discharge welded to the body 12. This combination of welding techniques forms a hybrid type of weld.

Shape of Connecting Portion and Second End Section

In accordance with the present subject matter, the second end section 18 is defined by the portion of the body 12 that is attached to the cutting segments 30 along with portions of the body 12 located therebetween.

In accordance with the present subject matter, the second end section 18 has a shape defined by one or more planes. That is, the shape of second end section 18 is defined by one or more depressions, cut-outs, bulges, steps, or the like. The shape of the second end section 18 is described herein independently from the surface of the second end section, the surface being either substantially smooth or alternatively, having current concentrators disposed thereon. For example, in FIG. 7*h*, the second end section 18 has a shape defined by a rounded depression, and a surface defined by a plurality of raised portions. Also for example, in FIG. 7*i*, the second end section 18 has a shape defined by a plane, and a surface that is substantially smooth.

The shape of the second end section depends on the location of the current concentrators. If current concentrators are only on the surface of the second end section 18, then the second end section has a shape defined by two or more planes. If the current concentrators are on the connecting portion 38, with or without being on the second end section 18, the second end section 18 is defined by a shape defined by one or more planes.

The shape of the second end section 18 can embody various forms as illustrated by non-limiting examples in FIGS. 1*a*-1*e*, 4*a*-4*b*, 5*a*-5*b*, 6*a*-6*b*, and 7*a*-7*k*.

The cutting segments 30 in each respective embodiment have a connecting portion 38 with a shape that corresponds to and depends upon the shape of the second end section 18.

In accordance with the present subject matter, the shape of the connecting portion 38 is defined by one or more planes that are substantially parallel to the one or more planes defining the shape of the second end section 18. That is, the shape of the connecting portion 38 is complementary to the shape of the second end section 18 such that they match up and mate like counterparts of a pair, and as illustrated in the figures. This communication between the matching shapes allows for good linking between the connecting portion 38 and the second end section 18 during capacitive discharge welding.

Figure 7A:
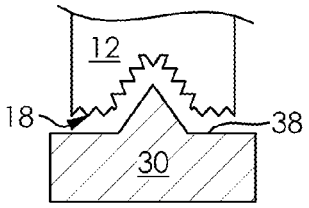
FIGS. 7*a*-7*k* are cross-sectional views showing various configurations of a second end section and corresponding cutting segment having mating surfaces.
Figure 7B:
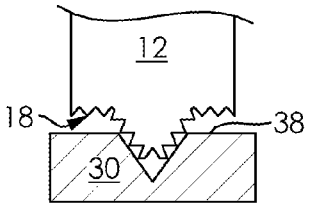
Figure 7C:
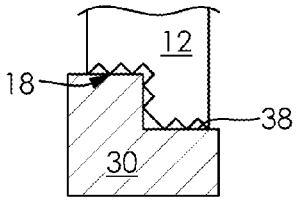
Figure 7D:
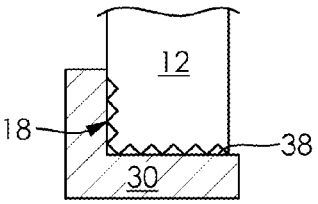
Figure 7E:
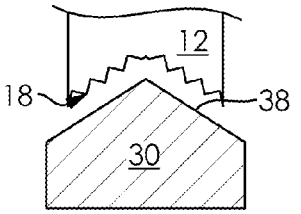
Figure 7F:
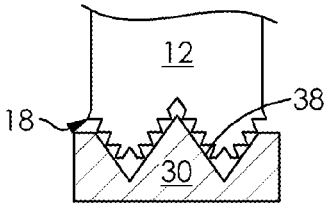
Figure 7G:
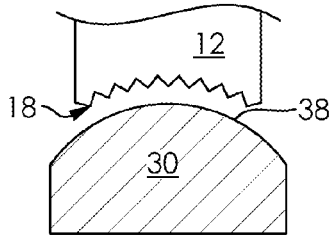

In FIG. 1*a*, another embodiment is shown where a second end section 18 has a shape defined by an annular depression in the form of two concentric steps extending around the circumference of the annular body 12. A plurality of concentric ridges is disposed on the tread portion of the two steps to define current concentrators on the second end section 18. FIG. 7*j* also depicts a cross-sectional view of a second end section 18 having a similar double step shape. It is understood that the plurality of raised portions defining the a plurality of current concentrators as depicted in FIGS. 7*a*-7*k* are not limited to concentric ridges, but can comprise raised portions as depicted in FIG. 8*a* or other like form.

In FIGS. 1*b* and 1*e*, another embodiment end section 18 is shown having a shape defined by an annular depression in the form of a V-shape, extending around the circumference of the body 12. FIG. 1*e* additionally includes reinforcing members 24 disposed between the cutting segments 30. In both FIGS. 1*b* and 1*e*, a plurality of concentric ridges is disposed on the annular V-shaped depression to define a plurality of current concentrators on the second end section 18. FIG. 7*e* also depicts a cross-sectional view of a second end section 18 having a similar V-shape.

Figure 9:
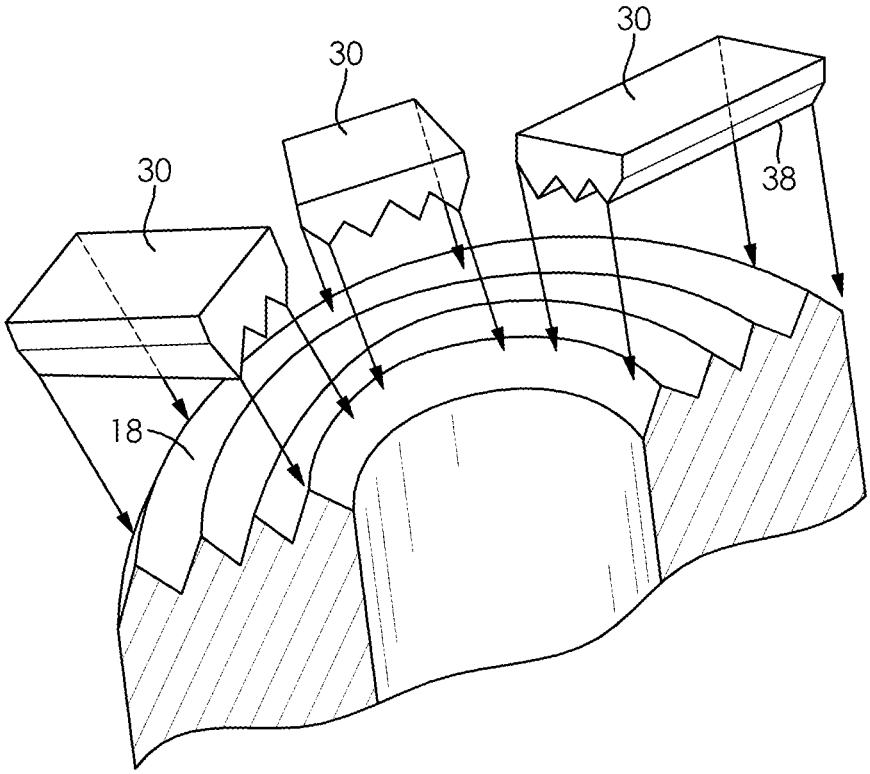
FIG. 9 is a perspective view of a cut-away portion of a drill bit body and a cutting segment, both having current concentrators disposed thereon.

In FIGS. 1*c* and 9, a second end section 18 is shown having a shape defined by an annular flat surface extending around the circumference of the body 12. The annular flat surface is substantially perpendicular to a length of the hollow cylindrical body 12. A plurality of ridges is disposed on the annular flat surface to define a plurality of current concentrators on the second end section 18. In these embodiments, a plurality of ridges defines a plurality of current concentrators also disposed on the connecting portion 38 of the cutting segment 30. As shown in FIGS. 1*c* and 9, the ridges on the second end section are aligned perpendicularly to the ridges on the connecting portion 38 thus producing electric resistance and current concentration for the welding at points where the ridges of the second end section 18 and the ridges of the connecting portion 38 contact. Depicted in FIG. 9 is a manner of perpendicularly aligning the ridges on the second end section and the ridges on the connecting portion by bringing them together as indicated by the arrows. FIGS. 7*i* and 7*k* also depict a second end section 18 having a similar shape defined by a flat surface. In these embodiments, current concentrators are disposed only on one of either the connecting portion 38 of the cutting segment 30 or on the second end section 18.

In FIG. 1*d*, a second end section 18 is shown having a shape defined by an annular step, extending around the circumference of the body 12. A plurality of ridges is disposed on the tread 18*a* and the riser 18*b* of the step to define current concentrators on the second end section 18. FIGS. 4*a*, 5*a*, 6*a*, and 7*d* also depicts a cross-sectional view of a second end section 18 having a similar single step shape.

Figure 7H:
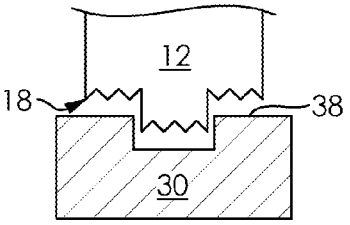
Figure 7I:
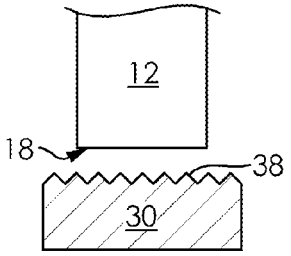
Figure 7J:
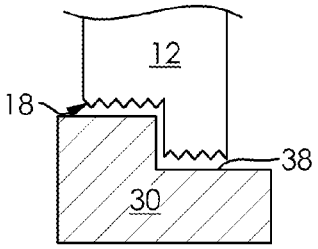
Figure 7K:
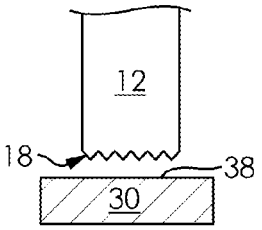

Other non-limiting examples of various embodiments of the shape of the second end section and corresponding connecting portion are depicted in FIGS. 7*a*, 7*b*, 7*f*, 7*g*, and 7*h*. Shown are cross sections of second end sections having a shape defined by two or more planes. A connecting portion of a cutting segment 30 is defined by a shape having two or more planes that are substantially parallel to the two or more planes defining the shape of the respective second end section 18. In particular, as shown in FIG. 7*h*, the second end section 18 has a shape defined by a rounded depression or gouge. By definition, a rounded depression has a curved surface that is defined by more than one plane. The cutting segment 30 in FIG. 7*h* has a rounded protrusion that matches with the rounded depression of the second end section 18, thus providing a strong bond after electrical discharge welding the pieces together.

Diamond Dispersion

The cutting segments 30 each have two or more portions having varying concentrations of diamond particles dispersed therein. In reference to FIGS. 2*a* and 10*a*-10*g*, at least one of the two or more portions has a first concentration H of diamond particles dispersed therein, and at least one of the two or more portions has a second concentration L of diamond particles dispersed therein. The first concentration H has more diamond particles than the second concentration L.

The two or more portions, having varying diamond concentrations, are arranged in the cutting segments in various configurations as depicted by non-limiting example in FIGS. 2*a* and 10*a*-10*g*. Although FIGS. 10*a*-10*g* do not depict each connecting portion as having a plurality of current concentrators or as having a variation in shape, it will be understood that, in accordance with the present subject matter, both characteristics can be present in the cutting segments in combination with the varying diamond particle concentrations discussed herein. For convenience in viewing the various diamond concentration configurations in the cutting segments, the depictions in FIGS. 10*a*-10*g* do not include variations in shape and the presence of current concentrators, and is not meant to limit the same. It is understood that the present subject matter includes combining the various non-limited diamond concentration configurations of FIGS. 10*a*-10*g*, with the various non-limited shapes of the connecting portions of the cutting segments of FIGS. 7*a*-7*j*, along with optionally having a plurality of current concentrators disposed on the connecting portions of the cutting segments.

Figure 10A:
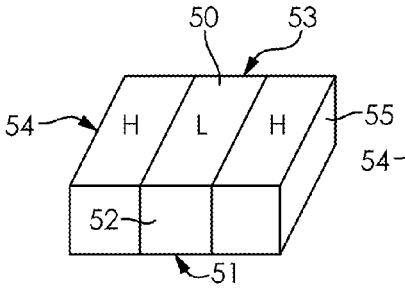
FIGS. 10*a*-10*g* are perspective views of various embodiments of a cutting segment, each showing diamond concentration configurations within a cutting segment.
Figure 10B:
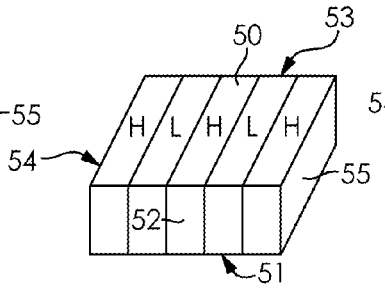
Figure 10C:
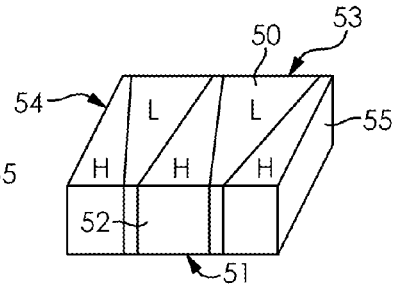
Figure 10D:
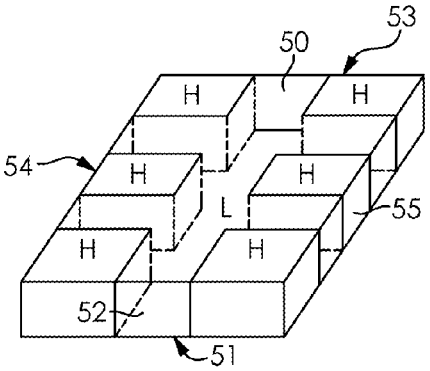
Figure 10E:
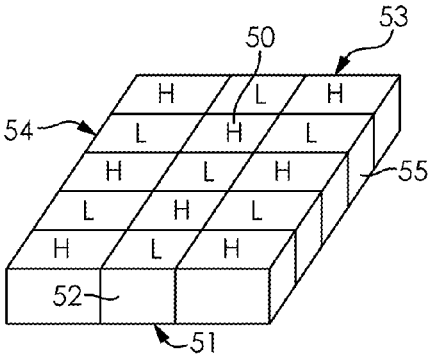
Figure 10F:
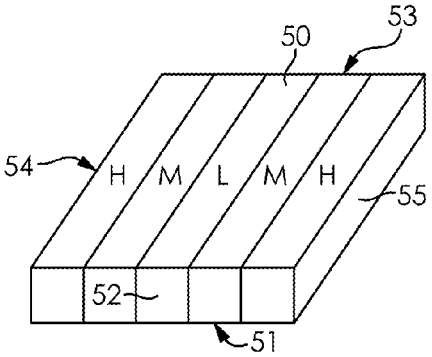
Figure 10G:
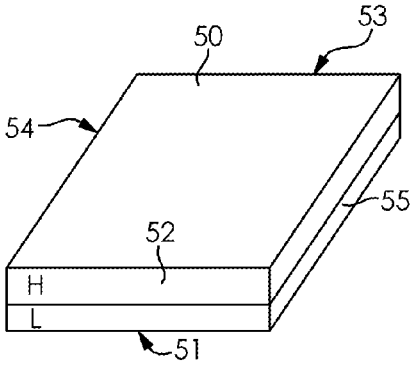

In one embodiment, and in reference to FIG. 10*a*-10*c* and 10*g*, the two or more portions extend from the leading face 52 to the trialing face 53 with the portions having the first concentration H and the portions having the second concentration L being alternately arranged from the outer face 54 to the inner face 55 as shown in FIGS. 10*a*-10*c*, or as shown in FIG. 10*g* being alternately arranged from the top face 50 to the bottom face 51. When the drill bit is constructed, the cutting segment depicted in FIG. 10*g* will be placed on the drill bit body so that the portion having the first concentration H is located furthest from the second end section of the body so as to come into contact with the associated material during drilling operations; and the portion having the second concentration L is located closest to the second end section so as to facilitate being welded thereto.

In one embodiment, the portions having the first concentration H have a width measurement that narrows or widens from the leading face 52 to the trailing face 53 with a corresponding respective increase or decrease in a width measurement of portions having the second concentration L, from the leading face 52 to the trailing face 53. One aspect of this embodiment is depicted in FIG. 10*c* where the width of the portions having the first concentration H narrows from the leading face 52 to the trailing face 53.

In another embodiment, each cutting segment 30 further includes one or more portions having the second concentration L that sever the portions having the first concentration H, as depicted in FIG. 10*d*. In still another aspect, each cutting segment 30 further includes one or more portions having the first concentration H that sever only the portions having the second concentration L that extend from the leading face 52 to the trailing face 53. This can produce a checkered pattern cutting segment, as depicted in FIG. 10*e*, or a staggered pattern cutting segment.

In another embodiment, the cutting segment 30 each have at least three portions and one of the at least three portions has a third concentration M of diamond particles dispersed therein. The third concentration M has less diamond particles than the first concentration H and more diamond particles that the second concentration L. The portions with the third concentration M extend from the leading face 52 to the trailing face 53 and are situated between the portions having the first H and second L concentrations. One aspect of this embodiment is shown in FIG. 10*f*.

The dispersion of diamonds in the various portions is generally such that first concentration H contains between about 20% and about 40% by weight more diamond particles as compared to the second concentration L. The present subject matter is not limited to this ratio, as it will be appreciated that in one embodiment, the second concentration L will not include any diamond particles therein. It will also be appreciated that although lines are shown in the figures to distinguish the two or more portions of the cutting segments having various diamond concentrations, in reality, such portions are structurally continuous and such portions can only be distinguished by their differential concentration of diamond particles.

The segments 30, which are pressed and sintered segments, may be produced in a conventional manner using care to control the weight percentage of diamond particles to attain an intended concentration within each portion. More particularly, in one embodiment the diamond particles are first mixed or dispersed into metal powder at a desired concentration, such as, for example, a conventional cobalt-iron-bronze alloy powder. Tungsten carbide and other cutting materials may also be added to the mixture. A different mixture(s) is then prepared for a portion(s) that is to have a different diamond concentration(s) compared to the first so as to provide greater or lesser concentration of diamonds in the various portions of the cutting segments 30. The different mixtures are then placed in a graphite mold so as to form the different portions of the segments 30 having various concentrations of diamond particles. The mixtures are then pressed and fired and/or sintered to form the segments 30. The segments 30 are then attached to the annular second end section 18 of the body 14 by using capacitive discharge welding. In one aspect, the weld is heat treated after the cutting segments are mounted to the drill bit body. Heat treating relieves any residual stress in the weld joint and makes the weld stronger.

The segments may be produced in a conventional manner using conventional means and include a dispersion of diamonds with a particle size of between 10/80 US Mesh and about 20/80 US Mesh. This designates a diamond particle size such that about 10 to about 4,000 of such particles are equivalent to one karat.

In another embodiment, the diamonds are systematically arranged within each portion of the cutting segments in varying concentrations as discussed herein. The diamond arrangements are attained by spacing the diamond particles at regular intervals in a predetermined pattern such that they form a three dimensional grid within the mass of the cutting segments. A substantially uniform grid of diamond particles within each portion of the cutting segments is thus produced. The grid pattern and/or particle spacing is modified within each portion of the cutting segments to produce portions having varying diamond concentrations.

In accordance with the present subject matter, the cutting segments welded to the drill bit body are not necessarily identical to each other. That is, the plurality of cutting segments can have varying diamond concentrations and varying concentration configurations between the various cutting segments. A non-limiting example of this embodiment is depicted in FIG. 2*a*, showing cutting segments 90, 91, 92, and 93 having alternating diamond concentration configurations. Segments 90 and 92 each has a portion with concentration L situated between two portions with concentration H that are at the outer 54 and inner face 55. Segments 91 and 93 each has a portion with concentration H situated between two portions with concentration L that are at the outer 54 and inner face 55. Other alternating or varying diamond concentrations and concentration configurations between a plurality of cutting segments are contemplated and are part of the present subject matter.

Methods

Figure 4A:
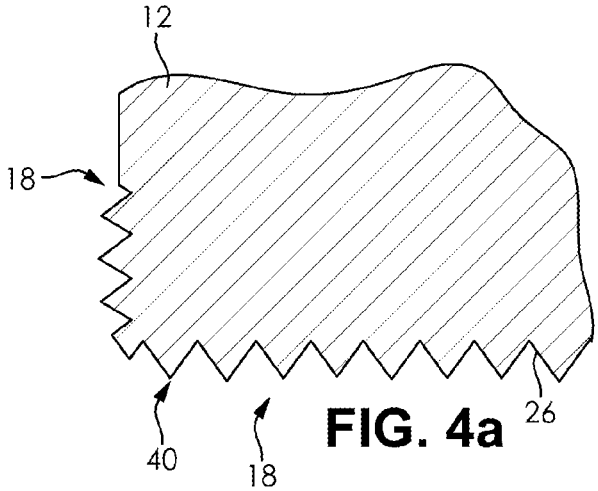
FIGS. 4*a*-4*b* are cross sectional views of two second end sections, each showing a second end section of a hollow cylindrical body of a drill bit before a cutting segment has been mounted thereto.
Figure 4B:
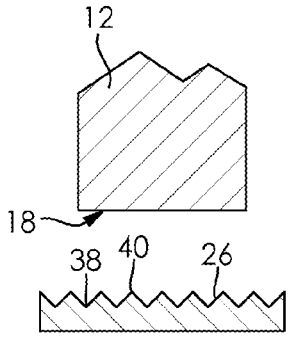

FIGS. 4*a*-4*b*, 5*a*-5*b*, and 6*a*-6*b* schematically illustrate a method by which the segments 30 are mounted to second end section 18 of the elongate tubular body 12. In accordance with one embodiment, each segment 30 is capacitive discharge welded to the second end section 18 of the tool body 12. As best illustrated in FIG. 4*a*-4*b*, prior to the welding, the surface of the second end section 18 is not conformed to the surface of the connecting portion 38 of the cutting segment 30. In accordance with the present subject matter, two exemplary embodiments of the second end section are shown in FIGS. 4*a* and 4*b*. In FIG. 4*a*, current concentrators 26, defined by a plurality of tapered raised portions 40, are disposed on the surface of the second end section 18; the second end section 18 having a shape defined by two planes. In FIG. 4*b*, the surface of the second end section 18 is initially substantially smooth and has a shape defined by one plane.

Figure 6A:
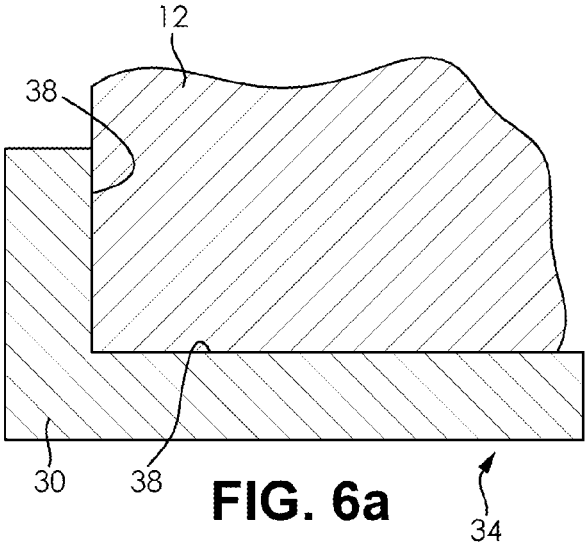
FIGS. 6*a*-6*b* are cross-sectional views of two second end sections, each showing the second end section of a hollow cylindrical body of a drill bit shown in FIG. 5*a*-5*b*, respectively, with the cutting segment mounted thereto.
Figure 6B:
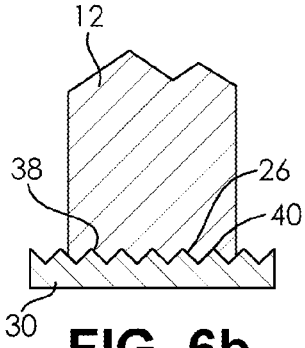

During this welding method, the surface of the second end section 18 is conformed to the surface of the connecting portion 38 of the cutting segments 30. The current concentrators 26 act to concentrate current locally so that one or both of the second end section 18 and the connecting portion 38 of the cutting segment 30 melt to thereby bond the cutting segment 30 with the body 12 and form a cutting head 14. In that way, the surface of the second end section 18 located in the cutting segment regions 34 are modified during the method of constructing the tool while, the surface of the second end section 18 located in the gap regions 36 remains unchanged and exposed after attaching the cutting segments as described. The surface of the second end section 18 in the gap regions 36 has a surface configuration corresponding to the configuration of those surfaces prior to the welding of the cutting segments 30 to the body 12. However, as best shown in FIGS. 6*a*-6*b*, the surface of the second end section 18 in the cutting segment regions 34 conforms to the surface of the connecting portion 38 of the cutting segment 30 in abutment therewith.

Figure 5A:
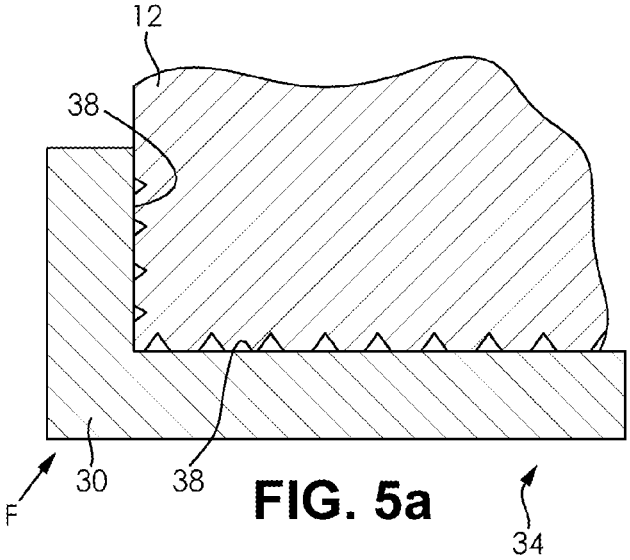
FIGS. 5*a*-5*b* are cross sectional views of two second end sections, each showing the second end section of a hollow cylindrical body of a drill bit shown in FIGS. 4*a*-4*b*, respectively, as the cutting segment is being mounted thereto.
Figure 5B:
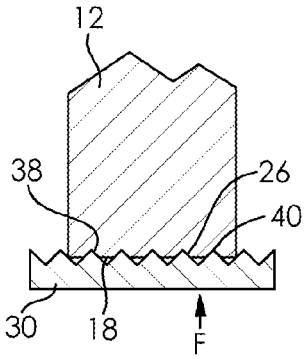

In one embodiment, the segments 30 are attached to the body 12 one at a time; however, it will be appreciated that it may be possible to weld two or more, or possibly all of the segments 30 at one time to the body 12. During the welding operation the segments (welded one at a time) may be pressed using a pressing force F during the electrical welding operation as shown in FIGS. 5*a*-5*b*. As an example, the cutting head segment 30 may be pressed with the cylindrical body using a pressure of about 6.6 Bar. Additionally, in one aspect, the resistance welding is performed using a capacitive discharge welding machine set to deliver a burst of energy of about 16K joules at a voltage of 3200V. An example of such a machine that is suitable for use with the present invention is a discharge machine made by Sciaky, Inc. of Chicago, Ill. Thereafter, the weld is heat treated to improve its strength.

It is to be appreciated that although a pressing force F is described and a particular range of energy other pressing forces may be utilized and other ranges of energy may be required more or less based upon application and specifically the size and number of segments being welded. In the subject embodiment, by way of example only and not for purposes of limiting the various embodiments, the cylindrical body 12 has an outside diameter of about 3.0 inches and a longitudinal length of about 2.375 inches. In another embodiment, the cylindrical body 12 has a outside diameter of about 3.7 inches and a longitudinal length of about 3.769 inches. Accordingly, scaling of the above-mentioned energy burst and/or pressing force F is to be expected.

If reinforcing members 24 are to be included, they are welded before, after, or in sequence with the cutting segments. At least one reinforcing member is capacitive discharge welded or laser welded to the second end section in each gap region. The reinforcing member is welded to span the gap region and to touch adjacent cutting segments in order to provide rotational support for the cutting segments. More than one reinforcing member can be welded in each gap region.

Reamer

Referring now to FIGS. 11*a*-11*b* and 12*a*-12*b*, there is shown a driver or reaming tool 100 suitable for use with the core drill bit 10. Reamer 100 is conventional in nature having a hollow cylindrical reamer body 105, with a first end 112, an opposite second end 110 and a mid-section 122. The second end 110, depicted as a male threaded end, is adapted to connect with the threaded portion 28 of the first end section 16 of the drill bit 10. The first end 112, as shown with a female threaded portion, is adapted for receiving pipe extensions. A plurality of reaming segments 115 are disposed along the outside of reamer body 105 at mid-section 122 and spaced apart to create reaming segment regions 140 and gap regions 141 on the reamer 100. The reaming segments 115 each have a top face 150, bottom face 151 comprising a joining portion 116, a leading face 152, a trailing face 153, a down-hole face 154, and an up-hole face 155. The joining portion 116 of the bottom face 151 of the reaming segment 115 is capacitive discharge welded to the mid-section 122 of the reamer body 105.

Figure 8B:
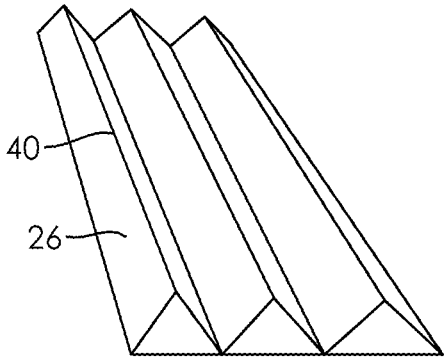
Figure 11A:
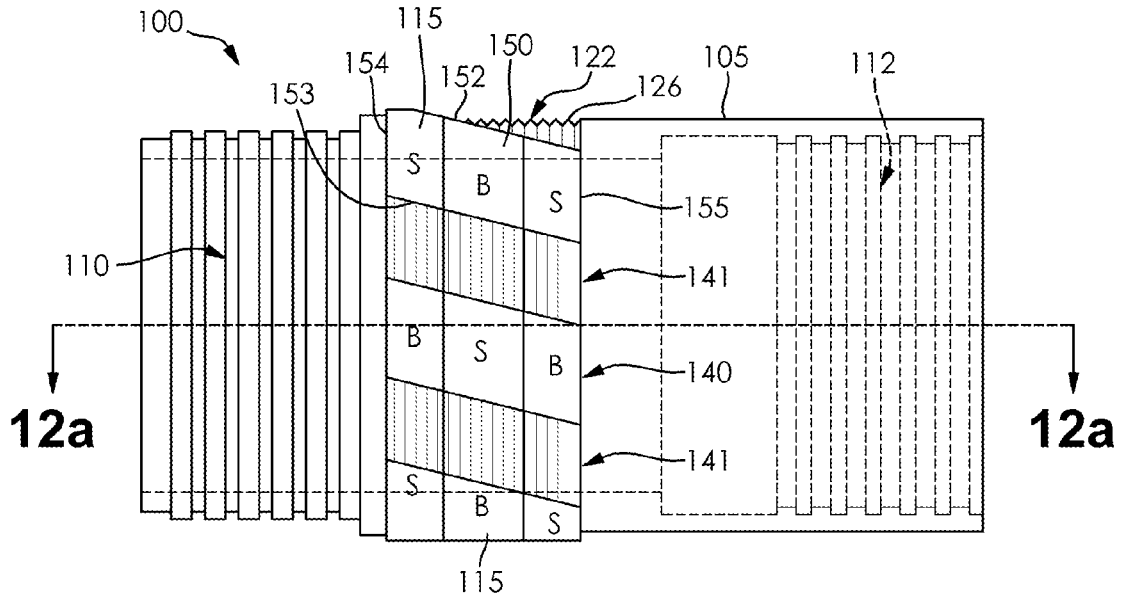
FIGS. 11*a*-11*b* are side views of two driver or reamer embodiments made in accordance with the invention.

Although segments 115 differ in shape from the segments 30 of bit 10, they are attached to the reamer body in a similar manner. One or both of the mid-section 122 of the reamer body 105, and joining portion 116 of the reaming segments 115, include a plurality of current concentrators 126. The current concentrators comprise a plurality of raised portions that taper to a point or edge that concentrates current during capacitive discharge welding the reaming segments 115 on the mid-section 122. The current concentrators 126 on the reamer 100 can be the same or different from the current concentrators 26 on an associated drill bit 10 and can comprise raised portions tapering to a point or edge. The raised portions can comprise single pointed raised portions or ridges as depicted in FIGS. 8*a* and 8*b*, respectively. If the plurality of raised portions comprises ridges, then the ridges can be situated concentrically around, longitudinally along, or diagonally across the mid-section 122 of the reamer 100. Shown in FIGS. 11*a* and 12*a* is a plurality of current concentrators comprising ridges disposed concentrically around the mid-section 122 of the reamer body 110. Shown in FIGS. 11*b* and 12*b* is a plurality of current concentrators disposed on the joining portion 116 of the reaming segments 115.

Although segments 115 differ in shape from the segments 30 of bit 10, they have a similar chemistry as previously mentioned herein, and comprise a metal or a mixture thereof comprising silver, molybdenum, tungsten, iron, copper, cobalt and carbides, including alloys and mixtures thereof, and diamonds. In one aspect, the reaming segments 115 also have similar diamond dispersion configurations as discussed herein with the cutting segments 30.

Like the cutting segments 30 of the drill bit 10, the reaming segments 115 of the reamer 100 each have two ore more zones having varying amount of diamond particles dispersed therein. At least one of the two or more zones has a first amount B of diamond particles dispersed therein, and at least one of the two or more zones has a second amount S of diamond particles dispersed therein. The first amount B has more diamond particles than the second amount S.

Figure 11B:
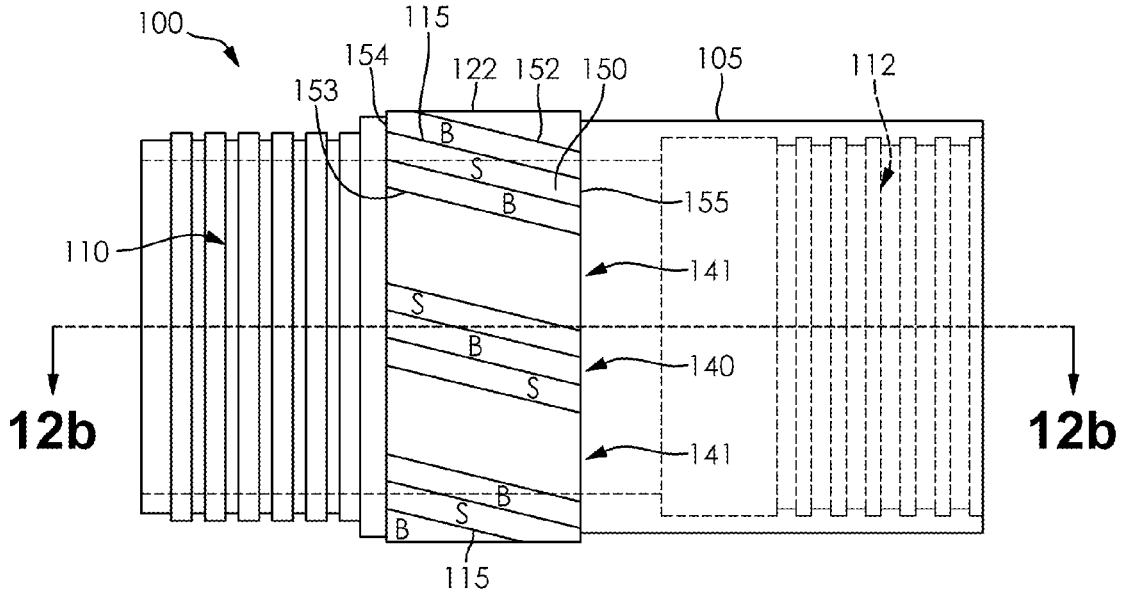
Figure 12A:
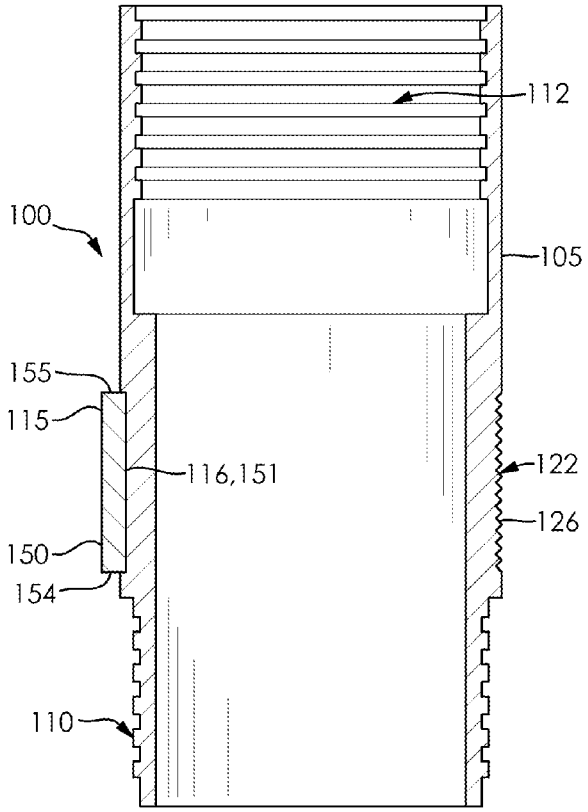
FIGS. 12*a*-12*b* are cross-sectional views of two embodiments of the reamer taken along line 12*a*-12*a* and 12*b*-12*b* of FIGS. 11*a*-11*b*, respectively.
Figure 12B:
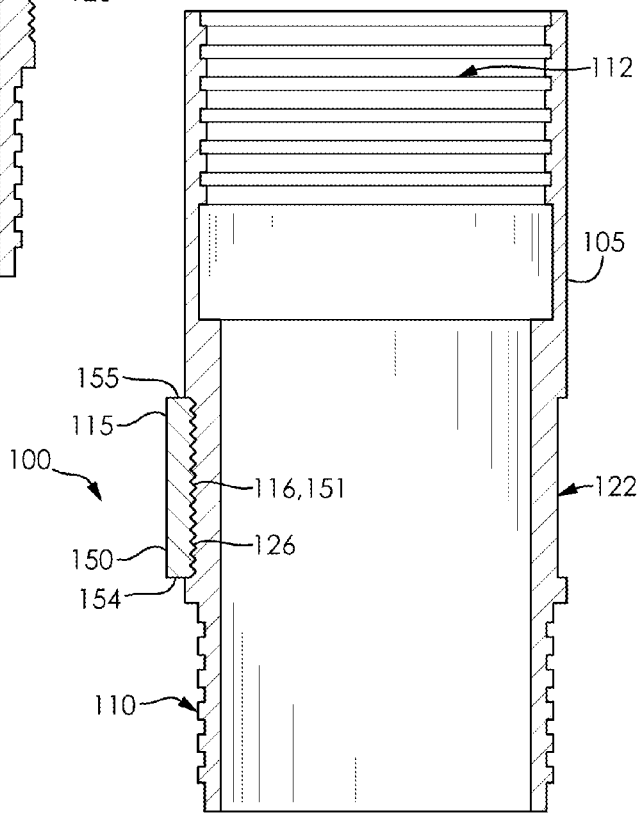

The two or more zones, having varying diamond concentrations, are arranged in the reaming segments in various configurations as depicted by non-limiting example in FIGS. 11*a*-11*b*. It is understood that the present subject matter includes combining the various non-limited diamond amount configurations of FIGS. 11*a*-11*b*, with optionally having current concentrators disposed on both the mid-section 122 and the joining portion 116 of the cutting segments 115.

In one embodiment, and in reference to FIG. 11*a*, the two or more zones extend from the leading face 152 to the trialing face 53 with the zones having the first amount B and the zones having the second amount S being alternately arranged from the down-hole face 154 to the up-hole face 155 as shown. It will be appreciated that the number of zones is not limited to three as depicted in FIGS. 11*a* and 11*b* but can be more. Also shown in FIG. 12*a* is the surface of the mid-section 122 being substantially conformed to the surface of the joining portion 116 wherein the plurality of current concentrators 126 on the mid-section 122 of the reamer body 110 are pressed and substantially leveled by the substantially smooth surface of the joining portion 116 of the reaming segments 115 during capacitive discharge welding.

In another embodiment, and in reference to FIG. 11*b*, the two or more zones extend from the down-hole face 154 to the up-hole face 155 with the zones having the first amount B and the zones having the second amount S being alternately arranged from the leading face 152 to the trailing face 153 as shown. Also shown in FIG. 12*b* is the surface of the mid-section 122 being substantially conformed to the surface of the joining portion 116 wherein the plurality of current concentrators 126 on the joining portion 116 of the reamer segments 115 are pressed into the substantially smooth mid-section 122 of the reamer body 110 during capacitive discharge welding.

Other embodiments for the reaming segments are contemplated to be similar to those that have been discussed herein in relation to the cutting segments, but adapted to the reaming segments for a reamer. These embodiments includes without limitation, having inserts within the reaming segments, having spacers between the reaming segments, variations to the form of the top face of the reamer, variations to the relative amount of diamonds in each zone, the production methods, diamond size, diamond configurations, and diamond spacing and arrangement.

The claimed invention has been described in connection with the exemplary embodiments. However, it is to be appreciated that the embodiments of the invention have use in equipment other than mining equipment, and in other applications such as drilling concrete, asphalt, masonry and related materials. Obviously, alterations and changes may occur to those of ordinary skill in the art upon a reading and understanding of this specification and any appended claims.

Core drill bits of the various embodiments exhibit truer cuts, better tracking and a longer life as compared to conventional bits which include cutting segments having uniform diamond dispersion attached to the tool body using brazing, infiltration or other techniques.

What is claimed is:

1. A drill bit comprising a hollow cylindrical body having a first end section and an opposite second end section, the drill bit further including a plurality of cutting segments that are separate and distinct from one another and from the body, the plurality of cutting segments each being separately mounted on the second end section of the body, the first end section having an attaching portion for selectively attaching the drill bit to a reamer or drill pipe, the second end section having an annular end surface and an outwardly facing cylindrical side surface extending about a drill bit axis, said each cutting segment of the plurality of cutting segments having at least one segment mounting face being fixed to at least one of the annular end surface and the outwardly facing cylindrical side surface such that the cutting segments are circumferentially spaced apart from one another on the second end section to define gap regions between adjacent cutting segments, the drill bit further comprising a plurality of reinforcing members that are separate and distinct from one another and from the cutting segments, each of the plurality of reinforcing members having at least one member mounting face, the at least one member mounting face being fixed to at least one of the annular end surface and the outwardly facing cylindrical side surface such that the reinforcing members are on the second end section within the gap regions, the reinforcing members spanning the gap regions to contact adjacent cutting segments.

2. The drill bit according to claim 1, wherein said each cutting segment of the plurality of cutting segments has at least two segment mounting faces fixed to the annular end surface and the outwardly facing cylindrical side surface.

3. The drill bit according to claim 1, wherein the at least one member mounting face of the reinforcing members are fixed to the annular end surface.

4. The drill bit according to claim 1, wherein the reinforcing members include at least two member mounting faces, the reinforcing members are fixed to the annular end surface and the outwardly facing cylindrical side surface.

5. The mining bit according to claim 1, wherein at least one of the annular end surface and the outwardly facing cylindrical side surface includes a plurality of current concentrators.

6. The drill bit according to claim 1, wherein the plurality of cutting segments are fixed to the at least one of the annular end surface and the outwardly facing cylindrical side surface of the body by laser welding.

7. The drill bit according to claim 1, wherein the plurality of cutting segments are fixed to the at least one of the annular end surface and the outwardly facing cylindrical side surface by capacitive discharge welding.

8. The drill bit according to claim 1, wherein the cutting segments each have a top face, a bottom face, an outer face, an inner face, a leading face, a trailing face, a height defined by the average distance between the bottom face and the top face, a width defined by the average distance between the inner face and the outer face, and a length defined by the average distance between the leading face and the trailing face; the reinforcing members each have a top facet, a bottom facet, an outer facet, and inner facet, a leading facet, a trailing facet, a height defined by the average distance between the bottom facet and the top facet, a width defined by the average distance between the inner facet and the outer facet, and a length defined by the average distance between the leading facet and the trailing facet wherein the height of each cutting segments is greater than the height of each of the reinforcing members.

9. The drill bit according to claim 1, wherein the plurality of reinforcing members are outwardly of the at least one of the annular end surface and the outwardly facing cylindrical side surface.

10. The drill bit according to claim 8, wherein the height of each of the cutting segments is from about 1.1 to about 5.0 times the height of the reinforcing members.

11. The drill bit according to claim 8, wherein the hollow cylindrical body has an outside radius and an inside radius, the difference between the outside radius and the inside radius defining a thickness of the body; the width of each of the cutting segments is from about 1.0 to about 2 times the thickness of the body at the second end section.

12. The drill bit according to claim 8, wherein the length of each of the cutting segments is from about 1.1 to about 5.0 times a distance between adjacent cutting segments that define each gap region.

13. The drill bit according to claim 1, wherein the at least one member mounting face of the reinforcing members span a substantial portion of the gap regions and the reinforcing members contact adjacent cutting segments radially outwardly of the outwardly facing cylindrical side surface of the body.

14. The drill bit according to claim 1, wherein the reinforcing members comprise one or more of molybdenum, silver, tungsten, iron, copper, cobalt, and carbide materials.

15. The drill bit according to claim 1, wherein the reinforcing members comprise steel.

16. The drill bit according to claim 1, wherein the drill bit is a mining drill bit.

17. The drill bit according to claim 1, wherein the reinforcing members further comprise diamond particles dispersed therein.

18. The drill bit according to claim 1, wherein the attaching portion includes a female threaded portion.

19. A drill bit comprising a hollow cylindrical body having a first end section and an opposite second end section, the drill bit further including a plurality of cutting segments that are separate and distinct from the body and mounted on the second end section of the body, the first end section having an attaching portion for selectively attaching the drill bit to a reamer or drill pipe, the cutting segments being circumferentially spaced apart on the second end section to define gap regions between adjacent cutting segments, the drill bit further comprising reinforcing members on the second end section in the gap regions, the reinforcing members spanning the gap regions to contact adjacent cutting segments and the reinforcing members engaging an outer surface of the body, the second end section comprises a plurality of current concentrators, the reinforcing members are separate and distinct from the body and from the cutting segments and the reinforcing members are mounted on the second end section by at least capacitive discharge welding.

20. The drill bit according to claim 19, wherein the reinforcing members are further mounted on the second end section by laser welding so as to provide a hybrid weld between the reinforcing members and the second end section.

21. A drill bit comprising a hollow cylindrical body having a first end section and an opposite second end section, the drill bit further including a plurality of cutting segments that are separate and distinct from the body and mounted on the second end section of the body, the first end section having an attaching portion for selectively attaching the drill bit to a reamer or drill pipe, the cutting segments being circumferentially spaced apart on the second end section to define gap regions between adjacent cutting segments, the drill bit further comprising reinforcing members on the second end section in the gap regions, the reinforcing members spanning the gap regions to contact adjacent cutting segments and the reinforcing members engaging an outer surface of the body, the second end section comprises a plurality of current concentrators, and the cutting segments are mounted on the second end section by at least capacitive discharge welding.

22. The drill bit according to claim 21, wherein the cutting segments are further mounted on the second end section by laser welding so as to provide a hybrid weld between the cutting segments and the second end section.

* * * * *